US011635724B2

(12) United States Patent
Kabata et al.

(10) Patent No.: US 11,635,724 B2
(45) Date of Patent: Apr. 25, 2023

(54) METHOD FOR MANUFACTURING REMOVABLE INFORMATION SHEET

(71) Applicants: Toshiyuki Kabata, Kanagawa (JP); Kaori Hemmi, Kanagawa (JP); Akira Azami, Kanagawa (JP); Takahiro Suzuki, Kanagawa (JP)

(72) Inventors: Toshiyuki Kabata, Kanagawa (JP); Kaori Hemmi, Kanagawa (JP); Akira Azami, Kanagawa (JP); Takahiro Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/468,742

(22) Filed: Sep. 8, 2021

(65) Prior Publication Data

US 2022/0075310 A1 Mar. 10, 2022

(30) Foreign Application Priority Data

Sep. 10, 2020 (JP) ..... JP2020-151851

(51) Int. Cl.
*G03G 15/00* (2006.01)
*G03G 9/087* (2006.01)
*G03G 15/20* (2006.01)

(52) U.S. Cl.
CPC ..... *G03G 15/6585* (2013.01); *G03G 9/08782* (2013.01); *G03G 15/2053* (2013.01)

(58) Field of Classification Search
CPC ..... G03G 15/2098; G03G 15/6582; G03G 15/6585; G03G 15/6588; G03G 15/6591; G03G 2215/00789; G03G 2215/00801
See application file for complete search history.

(56) References Cited

U.S. PATENT DOCUMENTS

2003/0170414 A1* 9/2003 Sato ..... D21H 27/001 428/40.1
2005/0250038 A1* 11/2005 McAneney ..... G03G 15/657 430/126.1

(Continued)

FOREIGN PATENT DOCUMENTS

JP 11-349854 12/1999
JP 2004-231890 8/2004

(Continued)

*Primary Examiner* — Thomas S Giampaolo, II
(74) *Attorney, Agent, or Firm* — Xsensus LLP

(57) ABSTRACT

A method for manufacturing a removable information sheet includes: forming a toner image on a recording medium; applying an energy-ray-curable pressure-sensitive composition precursor onto the medium to form an energy-ray-curable pressure-sensitive composition precursor layer; irradiating, with an energy ray, the medium to cure the layer and form an energy-ray-curable pressure-sensitive composition; and attaching faces with the composition and pressure-bonding the faces. A region size of a toner-image flat part is 200 μm or less in the image, which is determined by a measurement method including: defining a site at a depth of 2 μm or more from a surface of a solid part of the image as a recess; defining a site other than the recess as the flat part; acquiring and binarizing a micrograph of the solid part; drawing circles out of contact with the recess; and defining a largest circle diameter as the size of the flat part.

8 Claims, 7 Drawing Sheets

(56) References Cited

U.S. PATENT DOCUMENTS

| | | | | |
|---|---|---|---|---|
| 2007/0148414 | A1* | 6/2007 | Halfyard | B41M 7/0045 430/97 |
| 2014/0255069 | A1 | 9/2014 | Iio et al. | |
| 2018/0024462 | A1 | 1/2018 | Shimada et al. | |
| 2019/0271927 | A1 | 9/2019 | Inoue et al. | |
| 2019/0346782 | A1* | 11/2019 | Skvirsky | G03G 8/00 |
| 2020/0301328 | A1 | 9/2020 | Kabata et al. | |

FOREIGN PATENT DOCUMENTS

| | | |
|---|---|---|
| JP | 2012-098432 | 5/2012 |
| JP | 2015-014771 | 1/2015 |
| JP | 2015-030752 | 2/2015 |
| JP | 2015-075579 | 4/2015 |

* cited by examiner

METHOD FOR MANUFACTURING REMOVABLE INFORMATION SHEET

CROSS-REFERENCE TO RELATED APPLICATION

This patent application is based on and claims priority pursuant to 35 U.S.C. § 119(a) to Japanese Patent Application No. 2020-151851, filed on Sep. 10, 2020, in the Japan Patent Office, the entire disclosure of which is incorporated by reference herein.

BACKGROUND

Technical Field

Embodiments of the present invention relate to a method for manufacturing a removable information sheet.

Discussion of the Background Art

For recent direct mails, a procedure has been often used in which printing surfaces that have image information are bonded with a pressure-sensitive adhesive and can be re-peeled off if necessary. For the pressure-sensitive adhesive, latex rubbers, ultraviolet-curable pressure-sensitive compositions, and the like are used, and ultraviolet-curable pressure-sensitive compositions have been mainstream in the case of image information that has a large image area and an enhanced advertising effect.

In addition, recently, information has been frequently changed, thereby increasing the number of systems capable of outputting variable information, such as partially changing name or point information or the like. In addition, accelerated printing out and reduced costs of plate making for screen printing or the like have been desired, thereby increasingly resulting in requests for on-demand printing.

Typical devices for use in on-demand printing include an electrophotographic type and an inkjet type, and the electrophotographic type with toners used is advantageous in terms of productivity and cost for output including an image that is large in image area. Further, images recorded by electrophotography have colors reproduced by fixing, with heat, powdery coloring materials referred to as toners to a recording medium.

For the ultraviolet-curable pressure-sensitive compositions (so-called ultraviolet (UV) varnish), several commercially available ultraviolet-curable pressure-sensitive compositions are commonly used in offset printing. When these commercially available ultraviolet-curable pressure-sensitive compositions are used in electrophotography, however, satisfactory results are hardly obtained because of incompatibility between the toners and the ultraviolet-curable compositions. In general, a toner is composed of a resin, a pigment, an additive such as silica, a wax, and the like, which are also considered as one of the factors.

For example, a technology of using an ultraviolet-curable pressure-sensitive composition includes forming a toner image, coating the toner image with an ultraviolet-curable pressure-sensitive composition, and then heating and pressurizing the toner image.

In such a technology, toner images with an ultraviolet-curable composition laminated to each other are attached and pressure-bonded on heating, or toner images are pressure-bonded and then pressure-bonded again on heating, to prevent breakage of the toner images.

SUMMARY

According to an embodiment of the present invention, there is provided a method for manufacturing a removable information sheet. The method includes: forming a toner image on a recording medium with use of a toner; applying an energy ray-curable pressure-sensitive composition precursor onto the recording medium with the toner image formed to form an energy ray-curable pressure-sensitive composition precursor layer; irradiating, with an energy ray, the recording medium with the energy ray-curable pressure-sensitive composition precursor layer formed to cure the energy ray-curable pressure-sensitive composition precursor layer and form an energy ray-curable pressure-sensitive composition; and attaching faces with the energy ray-curable pressure-sensitive composition formed to each other and pressure-bonding the faces by a pressure bonding unit. A size of a region of a toner image flat part, determined by a measurement method, is 200 μm or less in the toner image formed by the forming. The measurement method includes: defining, in a solid part of the toner image, a site at a depth of 2 μm or more from a surface of the solid part as a recess; defining a site other than the recess as the toner image flat part; acquiring a micrograph of the solid part of the toner image; binarizing the micrograph; drawing circles out of contact with the recess in the toner image flat part; and defining a diameter of a largest circle among the circles drawn as the size of the region of the toner image flat part.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
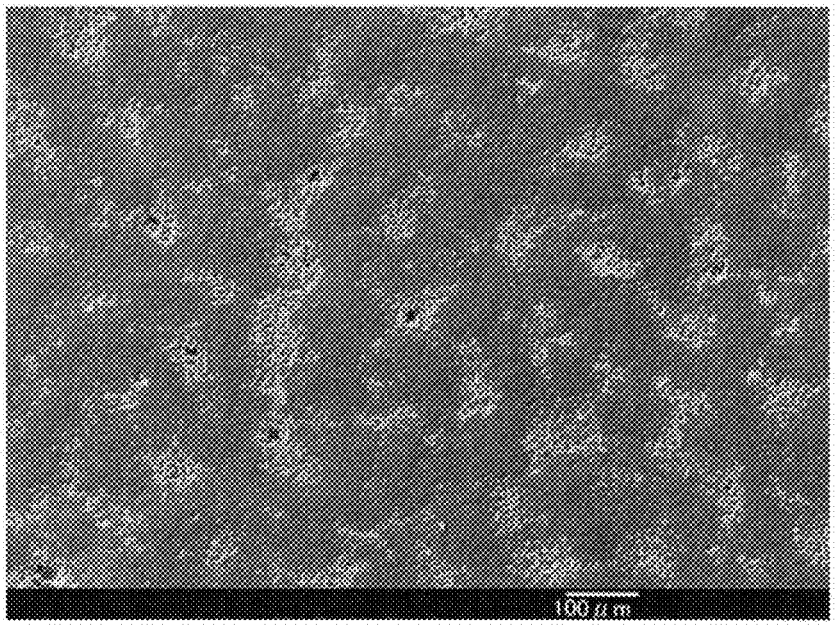
FIG. 1 is an example of an electron micrograph in a solid part of a toner image.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Pressure-bonding toner images with a conventional ultraviolet-curable pressure-sensitive composition may be disadvantageous in that the peeling strength is insufficient, thereby causing the toner images to fail to withstand vibrations during transport, or conversely, the peeling strength is excessively high, thereby peeling off one of the image in re-peeling. In addition, even without disadvantage immediately after pressure bonding, the adhesive strength may be insufficient or conversely increased during storage. In particular, in the case of a toner image that is high in area ratio, the ultraviolet-curable pressure-sensitive composition partially penetrating into sheets is insufficiently cured, and when pressure-bonded postcards are prepared from the sheets and peeled off after several days, the image is peeled off in some cases.

Moreover, when the pressure-bonded postcards prepared according to the related art are stored in a high-humidity environment, the adhesive strength between the surface of the toner image and the ultraviolet-curable pressure-sensitive composition may be decreased, although the toner image is not broken. Thus, when the pressure-bonded postcard is peeled off, disadvantageously, the ultraviolet-curable pressure-sensitive composition at the surface of the toner image partially adheres to the ultraviolet-curable pressure-sensitive composition at the surface of the toner image on the other side bonded. In this condition, the re-peeled image is not so beautiful as to be used for any (direct mail) DM, but rather gives poor impression with respect to the information. The pressure-bonded postcards need to have removability while being delivered by mail for several days after being dropped.

Figure 8:
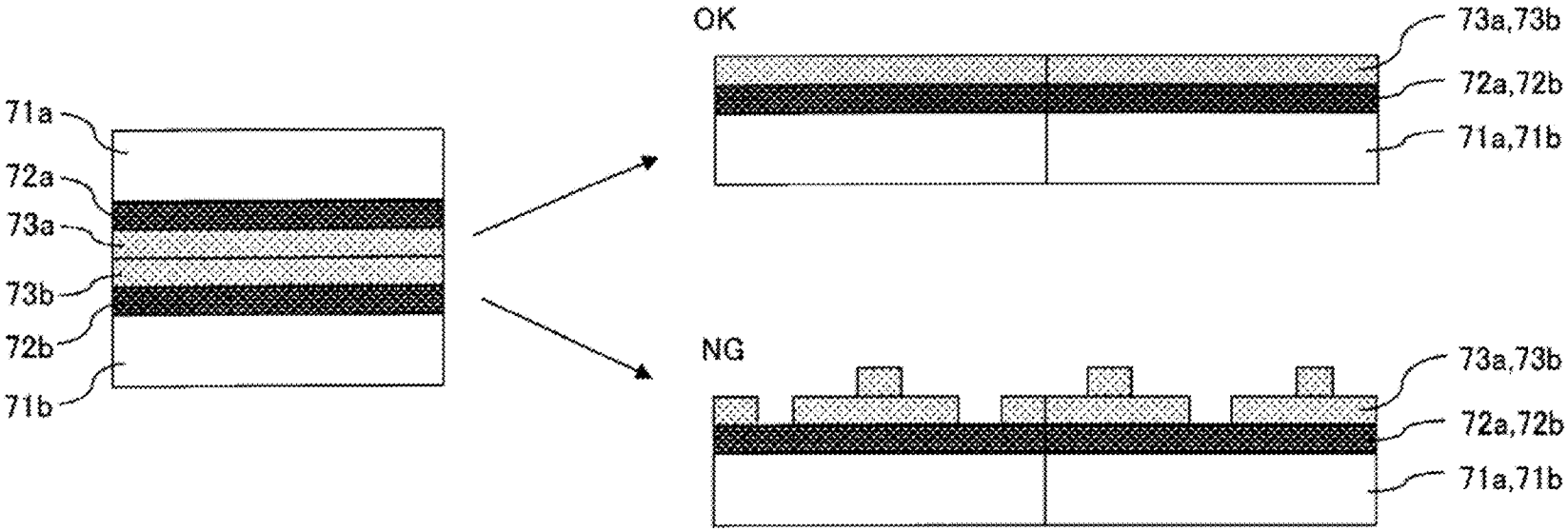
FIG. 8 is a diagram illustrating an example of the layer configuration of a removable information sheet and an example in the case of peeling off the removable information sheet.

For example, as illustrated on the left side of FIG. 8, a twofold (V-folded) pressure-bonded postcard includes six layers of coated papers 71*a* and 71*b*, toner images 72*a* and 72*b*, and ultraviolet-curable pressure-sensitive compositions 73*a* and 73*b*. The case where the postcard can be successfully peeled off is achieved as illustrated in the upper right of FIG. 8. In contrast, when the adhesive strength between the toner image 72*a* and the ultraviolet-curable pressure-sensitive composition 73*a* or between the ultraviolet-curable pressure-sensitive composition 73*b* and the toner image 72*b* is lower than the adhesive strength between the ultraviolet-curable pressure-sensitive composition 73*a* and the ultraviolet-curable pressure-sensitive composition 73*b*, the ultraviolet-curable pressure-sensitive composition is peeled from the toner image, then adhering to the other ultraviolet-curable pressure-sensitive composition (lower right in FIG. 8).

In the related art, when the pressure-bonded postcard is peeled off, the ultraviolet-curable pressure-sensitive composition is peeled partially from the toner image in a so-called solid part that is large in image area at each site of the images bonded to each other, thus significantly degrading the gloss of the image surface.

Embodiments of the present invention solve such a disadvantage of a removable information sheet with a toner image used, in particular, the disadvantage of, in re-peeling the sheet, partially peeling a layer of energy ray-curable pressure-sensitive composition precursor cured, and provide a method for manufacturing a removable information sheet, which provides a removable information sheet that has excellent adhesion and excellent removability and has a very beautiful image after re-peeling the sheet.

Hereinafter, a method for manufacturing a removable information sheet according to an embodiment of the present invention will be described with reference to the drawings. It is to be noted that the present invention is not to be considered limited to the following embodiments, but can be changed within the range that can be conceived of by those skilled in the art, such as other embodiments, additions, modifications, deletions, and the scope of the present invention encompasses any aspect, as long as the aspect achieves the operation and advantageous effect of the present invention.

The present inventors have investigated in detail the reason of favorable adhesiveness between an ultraviolet-curable pressure-sensitive composition and an image at a site that has a small image area to find extremely favorable adhesion between a coated paper and the ultraviolet-curable pressure-sensitive composition. Furthermore, the present inventors have found that even in a solid part, in a single-color image from only a cyan, magenta, yellow, or black toner, that is, in a so-called monochromatic image part, the ultraviolet-curable pressure-sensitive composition has favorable adhesion, whereas the ultraviolet-curable pressure-sensitive composition has poor adhesion in a solid part of a so-called multicolor image.

The site that has a small image area and the monochromatic image part where the ultraviolet-curable pressure-sensitive composition has favorable adhesion have been subjected to detailed analysis to find that the site that has a small image area has many sites without any toner image, where the surface of the coated paper is exposed. Because of extremely favorable adhesion between the coated paper and the ultraviolet-curable pressure-sensitive composition, it has been found that even if the toner image and the ultraviolet-curable pressure-sensitive composition are slightly poor in adhesion, which is not significant, then the ultraviolet-curable pressure-sensitive composition is retained at the favorably adhesive site.

In contrast, it has been found that the solid part of the multicolor image has a site where the ultraviolet curable pressure-sensitive composition is slightly poor in adhesion, the adhesiveness is deteriorated in storage under high humidity, and the ultraviolet-curable pressure-sensitive composition is partially peeled off in the case of re-peeling.

The present inventors have examined in detail a part of the ultraviolet-curable pressure-sensitive composition that is not peeled off even in the solid part of the multicolor image. The solid part of the multicolor image typically has 2 to 3 pieces of toner laminated and melted by heat of fixing as a layer of toner image, and the surface of the toner image has a smooth shape. Even in the solid part, however, the surface of the toner image has a part without 1 to 3 pieces of toner. Because of the part recessed as compared with the surface of the toner image, it has been found that the ultraviolet-curable pressure-sensitive composition precursor into the recess, thereby causing the anchoring effect to improve the adhesiveness.

It has been found that as the number of recesses is larger as compared with the surface of the toner image, in particular, as the distance between the recess and another recess is shorter, adhesiveness can be maintained even in storage under high humidity. It has been found that, in particular, as long as the distance between the recess and another recess is 200 μm or less, the adhesiveness is not deteriorated even in the solid part of the multicolor image even in storage under high humidity, thereby leading to the present invention.

More specifically, the method for manufacturing a removable information sheet according to an embodiment of the present invention is a method for manufacturing a removable information sheet, the method including: a toner image forming step of forming a toner image on a recording medium with use of a toner; an applying step of applying an energy ray-curable pressure-sensitive composition precursor onto the recording medium with the toner image formed to form an energy ray-curable pressure-sensitive composition precursor layer; a curing step of irradiating, with an energy ray, the recording medium with the energy ray-curable pressure-sensitive composition precursor layer formed to cure the energy ray-curable pressure-sensitive composition precursor layer and form an energy ray-curable pressure-sensitive composition; and a pressure bonding step of attaching faces with the energy ray-curable pressure-sensitive composition formed to each other and pressure-bonding the faces by a pressure bonding unit, where a size of a region of a toner image flat part, determined by the following measurement method, is 200 μm or less in the toner image formed by the toner image forming step.

Measurement Method

In a solid part of the toner image, a site at a depth of 2 μm or more from the surface is defined as a recess, the other site is defined as the toner image flat part, a micrograph of the solid part of the toner image is acquired, the micrograph is binarized, circles are drawn out of contact with the recess in the toner image flat part, and the diameter of the largest circle among the drawn circles is defined as the size of the region of the toner image flat part.

Size of Region of Flat Part

The size of the region of the toner image flat part in the solid part of the multicolor image on the surface of the recording medium obtained in the toner image forming step in the method for manufacturing the removable information sheet according to the present invention can be determined in accordance with the following method ((1) to (3)).

(1) A micrograph of the solid part of the multicolor image is acquired with an optical microscope, an electron microscope, or a scanning probe microscope (SPM). FIG. 1 illustrates an example of the electron micrograph. The recess is smaller in height than the image flat part, and thus appears white in FIG. 1. In particular, the boundary between the image flat part and the recess can be clearly identified by the edge effect. Although FIG. 1 is an electron micrograph, the image flat part and the recess can be clearly distinguished in other micrographs.

The magnification of the micrograph may be any magnification as long as the size of the image flat part can be adequately measured. When the magnification is excessively high, however, the image flat part can be only locally obtained, and thus, it is desirable to obtain a photograph of a region of 500 μm or more at least on a side.

Figure 2:
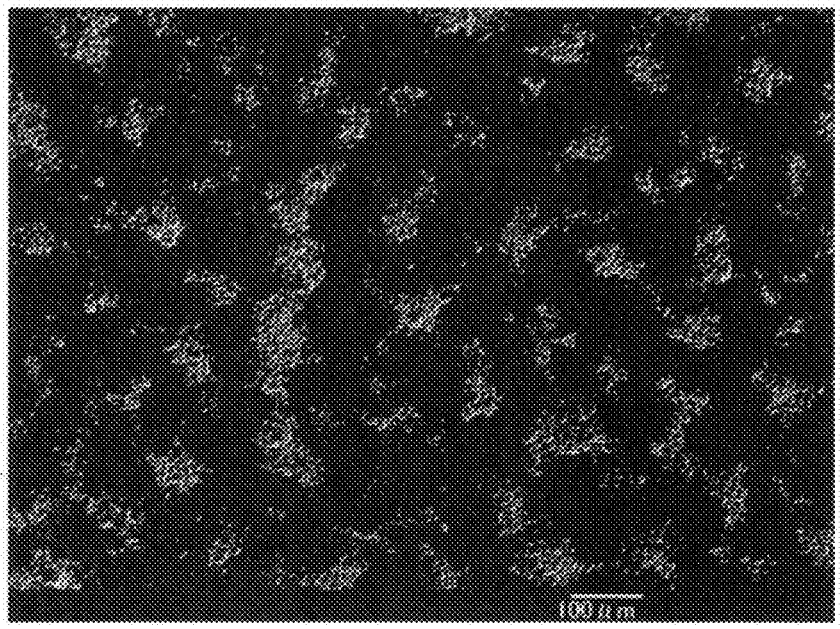
FIG. 2 is an image obtained by binarizing FIG. 1.

(2) The micrograph obtained in the foregoing (1) is binarized to clarify the image flat part and the recess. FIG. 2 illustrates the binarized electron micrograph of FIG. 1. The black part in FIG. 2 is an image flat part, and the white part therein is a recess. When the binarization is performed, a part of 2 μm or more in depth from the surface appears as a white part.

Figure 3:
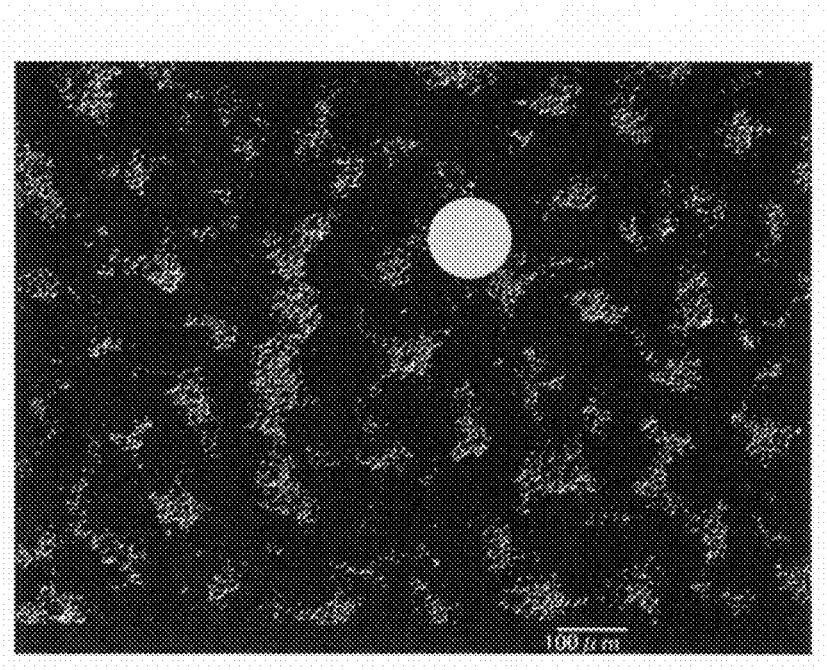
FIG. 3 is a diagram illustrating a size of a region of a toner image flat part in FIG. 2.

(3) On the binarized image obtained in the foregoing (2), circles are drawn on the image flat part, the diameter of the largest circle is determined among the circles out of contact with any recess, and the value is defined as the size of the region of the toner image flat part. FIG. 3 is a diagram illustrating the size of a region of the toner image flat part in FIG. 2. The circle illustrated in FIG. 3 is the largest circle among the circles drawn on the image flat part. In FIG. 3, the size of the region of the toner image flat part is 113 μm.

As described above, in the case of a micrograph, it is desirable to acquire a photograph of a region of, for example, 500 μm or more on a side. The recesses of the solid part are present in a substantially uniform fashion, and a micrograph of 500 μm or more on a side is thus enough. In the case of using a micrograph of less than 500 μm on a side, however, a number of micrographs corresponding to an area of 500 μm or more on a side is used.

In the recording medium with an image formed by the toner image forming step in the method for manufacturing a removable information sheet according to the present invention, as long as the region of the toner image flat part in the solid part of the multicolor image is 200 μm or less, the adhesiveness of the energy ray-curable pressure-sensitive composition is not deteriorated even if the removable information sheet is manufactured and stored under high humidity.

Figure 4:
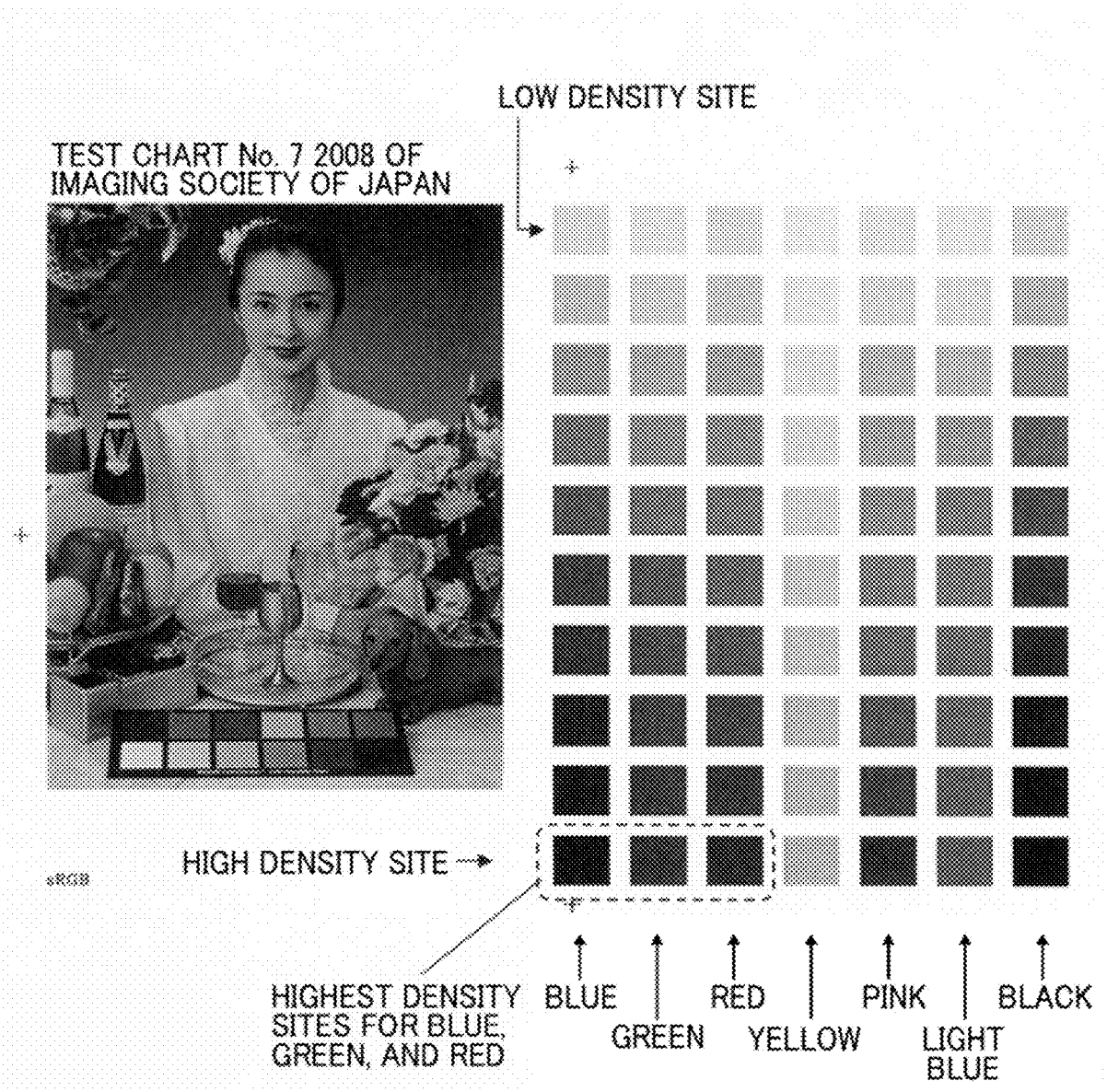
FIG. 4 is a diagram illustrating the test chart No. 7 2008 of the Imaging Society of Japan and supplementary explanations thereof.

Examples of the method for checking whether the size of the region of the toner image flat part is 200 μm or less include a method of forming an image in accordance with the test chart No. 7 2008 of the Imaging Society of Japan. FIG. 4 illustrates the test chart No. 7 2008 of the Imaging Society of Japan and supplementary explanations thereof.

In the case where an image in accordance with the test chart No. 7 2008 of the Imaging Society of Japan is formed by the toner image forming step in the method for manufacturing a removable information sheet according to the present invention, the size of the region of the toner image flat part is 200 μm or less at sites with the highest density of blue, green, or red on the right side of the image (the sites indicated by the dashed line in the drawing). The toner image flat parts at these sites have the largest region, and thus, in the case where the region of the toner image flat parts at these sites has a site of 200 μm or less, the region of the toner image flat parts at the other sites is always 200 μm or less.

When the toner image flat part at sites with the highest density of blue, green, or red on the right side of the image formed in accordance with the test chart No. 7 2008 of the Imaging Society of Japan have a region of 200 μm or less, the toner image flat part always has a region of 200 μm or less in the solid part of the other toner image. It is to be noted that it is desirable to examine the region of the toner image flat parts at all of the sites with the highest density of blue, green, or red on the right side of the image formed in accordance with the test chart No. 7 2008 of the Imaging Society of Japan, but it is only necessary to examine any one color.

Examples of the approach for forming the toner image such that the region of the toner image flat part has a size of 200 μm or less include: reducing the image density; and changing the type of the voltage applied in the transfer step for forming the toner image.

In the toner image formed by the toner image forming step, the size of the region of the toner image flat part is not particularly limited, but is preferably not smaller than 60 μm. Finally, the ultraviolet-curable pressure-sensitive composition is laminated on the toner image, thus making the recess hardly noticeable. When the size is smaller than 60 μm, however, the density of the entire image is reduced. In addition, the size of smaller than 60 μm is not preferred because of giving the impression that the entire image is rough.

Figure 5:
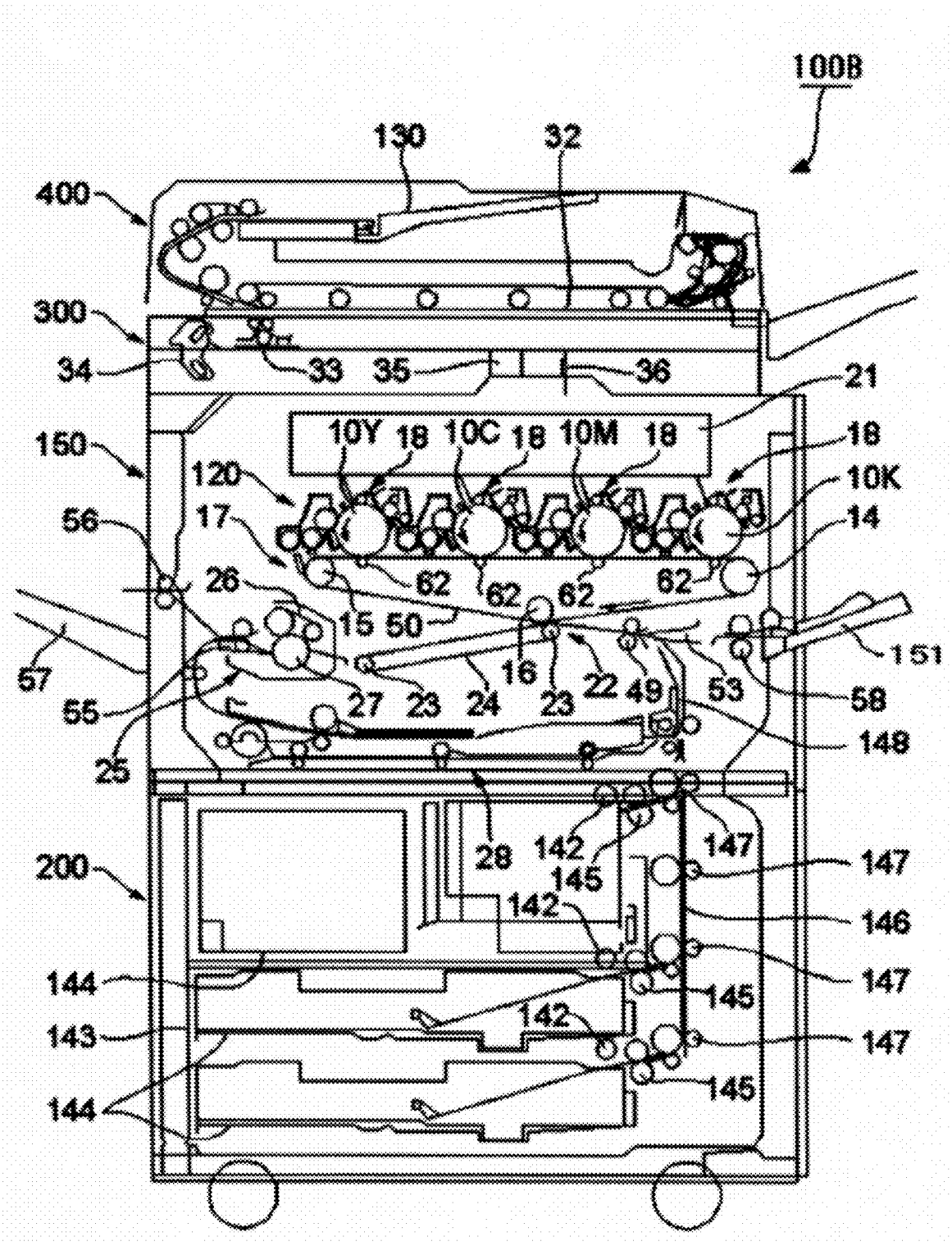
FIG. 5 is a diagram illustrating an example of an image forming apparatus.

Hereinafter, details of the method for manufacturing a removable information sheet according to an embodiment of the present invention will be described together with an example of an image forming apparatus that is used for carrying out the present invention. FIG. 5 illustrates an example of an image forming apparatus for use in the present embodiment.

The image forming apparatus that performs the toner image forming step in the present embodiment includes, for example, an image bearer, an electrostatic latent image forming means, a developing means, a transfer means, and a fixing means. The image forming apparatus may include a cleaning unit, and may further include other means appropriately selected as necessary, for example, a neutralizing unit, a recycling unit, a controller, and the like. In addition, the image forming apparatus may include, for performing an applying step as described later, an applying and curing unit.

In the toner image forming step in the present embodiment, an electrostatic latent image forming step, a developing step, a transfer step, and a fixing step are performed.

Electrostatic Latent Image Forming Step and Electrostatic Latent Image Forming Unit The electrostatic latent image forming step is a step of forming an electrostatic latent image on an image bearer.

Image Bearer

The material, shape, structure, size, and the like of the image bearer (may be referred to as an "electrostatic latent image bearer" or a "photoconductor") are not particularly limited, and can be appropriately selected from known bearers. For example, preferred examples of the shape include a drum shape, and examples of the material include inorganic photoconductors such as amorphous silicon and selenium, and organic photoconductors such as polysilane and phthalopolymethine.

The image bearer (photoconductor) for use in the image forming apparatus includes, for example, a conductive support and at least a photosensitive layer on the conductive support, and further includes other layers, as necessary.

Examples of the photosensitive layer include a single-layer type in which a charge generating material and a charge transporting material are mixed, a normally layered type in which a charge transporting layer is provided on a charge generating layer, and a reversely layered type in which a charge generating layer is provided on a charge transporting layer. In addition, an outermost surface layer can be also provided on the photosensitive layer, for improving the mechanical strength, abrasion resistance, gas resistance, cleanability, and the like of the photoconductor. In addition, an undercoating layer may also be provided between the photosensitive layer and the conductive support. In addition, an appropriate amount of plasticizer, antioxidant, leveling agent, or the like may be added to each layer, as necessary.

The conductive support is not particularly limited as long as the conductive support exhibits conductivity with a volume resistance of $1.0\times10^{10}$ Ω·cm or less, and can be appropriately selected in accordance with the intended use. For example, a film-shaped or cylindrical plastic or paper coated by vapor deposition or sputtering, or with a metal such as aluminum, nickel, chromium, nichrome, copper, gold, silver, or platinum, or a metal oxide such as a tin oxide or an indium oxide, or a plate such as aluminum, an aluminum alloy, nickel, or stainless steel, and a tube obtained in a manner such that the plate is made into a drum-shaped form by a method such as extrusion or drawing and then subjected to a surface treatment such as cutting, super finishing, or polishing can be used.

The drum-shaped support preferably has a diameter of 20 to 150 mm, more preferably 24 to 100 mm, even more preferably 28 to 70 mm. When the diameter of the drum-shaped support is less than 20 mm, it may be physically difficult to arrange the respective steps of charging, exposure, development, transfer, and cleaning around the drum. When the diameter exceeds 150 mm, the image forming apparatus may undergo an increase in size. In particular, in the case where the image forming apparatus is tandem, it is necessary to mount a plurality of photoconductors, and the diameter is thus preferably 70 mm or less, more preferably 60 mm or less.

Furthermore, such an endless nickel belt as disclosed in JP 52-36016-A or an endless stainless belt can also be used as the conductive support.

The undercoating layer of the photoconductor may be a single layer or composed of multiple layers, and examples thereof include (1) a layer containing a resin as a main component, (2) a layer containing a white pigment and a resin as main components, and (3) a metal oxide film obtained by chemically or electrochemically oxidizing the surface of a conductive substrate. Among these examples, the layer containing a white pigment and a resin as main components is preferred.

Examples of the white pigment include metal oxides such as a titanium oxide, an aluminum oxide, a zirconium oxide, and a zinc oxide, and among these examples, a titanium oxide that is excellent in preventing charge injection from the conductive support is particularly preferred.

Examples of the resin include thermoplastic resins such as a polyamide, a polyvinyl alcohol, a casein, and a methyl cellulose; and thermosetting resins such as an acryl, a phenol, a melamine, an alkyd, an unsaturated polyester, and epoxy. These examples may be used alone, or two or more thereof may be used in combination.

The thickness of the undercoating layer is not particularly limited, and can be appropriately selected in accordance with the intended use, and is preferably 0.1 to 10 μm, more preferably 1 to 5 μm.

Examples of the charge generating material in the photosensitive layer include organic pigments or dyes such as azo pigments such as monoazo-pigments, bisazo-pigments, trisazo-pigments, and tetrakis azo-pigments, triarylmethane dyes, thiazine dyes, oxazine dyes, xanthene dyes, cyanine dyes, styryl dyes, pyrylium dyes, quinacridone pigments, indigo pigments, perylene pigments, polycyclic quinone pigments, bisbenzimidazole pigments, indazolone pigments, squarylium pigments, and phthalocyanine pigments; and inorganic materials such as selenium, selenium-arsenic, selenium-tellurium, cadmium sulfide, zinc oxide, titanium oxide, and amorphous silicon. These examples may be used alone, or two or more thereof may be used in combination.

Examples of the charge transporting material in the photosensitive layer include anthracene derivatives, pyrene derivatives, carbazole derivatives, tetrazole derivatives, metallocene derivatives, phenothiazine derivatives, pyrazoline compounds, hydrazone compounds, styryl compounds, styrylhydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. These examples may be used alone, or two or more thereof may be used in combination.

As a binder resin for photosensitive layers, used for forming the photosensitive layer, thermoplastic resins, a thermosetting resins, photocurable resins, photoconductive resin, and the like that can be used, which are electrically insulating and known per se. Examples of the binder resin for photosensitive layers include thermoplastic resins such as a polyvinyl chloride, a polyvinylidene chloride, a vinyl chloride-vinyl acetate copolymer, a vinyl chloride-vinyl acetate-maleic anhydride copolymer, an ethylene-vinyl acetate copolymer, a polyvinyl butyral, a polyvinyl acetal, a polyester, a phenoxy resin, a (meth)acrylic resin, a polystyrene, a polycarbonate, a polyarylate, a polysulfone, a polyethersulfone, and an acrylonitrile butadiene styrene (ABS) resin; thermosetting resins such as a phenol resin, an epoxy resin, a urethane resin, a melamine resin, an isocyanate resin, an alkyd resin, a silicon resin, and a thermosetting acrylic resin; and a polyvinyl carbazole, a polyvinyl anthracene, and a polyvinyl pyrene. These examples may be used alone, or two or more thereof may be used in combination.

Examples of the antioxidant include phenolic compounds, paraphenylenediamines, hydroquinones, organic sulfur compounds, and organic phosphorus compounds. Examples of the phenolic compound include 2,6-di-t-butyl-p-cresol, butylated hydroxyanisole, 2,6-di-t-butyl-4 ethylphenol, stearyl-β-(3,5-di-t-butyl-4 hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid] glycol ester, and tocopherols.

Examples of the paraphenylenediamines include N-phenyl-N'-isopropyl-p-phenylenediamine, N,N-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropionate, distearyl-3,3'-thiodipropionate, and ditetradecyl-3,3'-thiodipropionate.

Examples of the organic phosphorus compounds include triphenylphosphine, tri(nonylphenyl)phosphine, tri(dinonylphenyl)phosphine, tricresylphosphine, and tri(2,4-dibutylphenoxy)phosphine.

These compounds are known as antioxidants for rubbers, plastics, fats and oils, and the like, and commercially available products are easily available for the compounds.

The amount of the antioxidant added is preferably 0.01 to 10% by mass with respect to the total mass of the layer to be added.

As the plasticizer, compounds for use as plasticizers for common resins, such as a dibutyl phthalate or a dioctyl phthalate, can be used as they are, and the used amount thereof is appropriately about 0 to 30 parts by mass with respect to 100 parts by mass of the binder resin for photosensitive layers.

In addition, a leveling agent may be added to the photosensitive layer. As the leveling agent, a silicon oil such as a dimethyl silicon oil and a methyl phenyl silicon oil; or a polymer or oligomer having a perfluoroalkyl group in the chain is used. The amount of the leveling agent used is preferably 0 to 1 parts by mass with respect to 100 parts by mass of the resin.

Charging and Exposure

The electrostatic latent image can be formed by, for example, uniformly charging the surface of the image bearer and then exposing the surface to light in an imagewise manner, and can be formed by the electrostatic latent image forming unit. The electrostatic latent image forming unit at least includes, for example, a charger that uniformly charges the surface of the image bearer, and an exposure device that exposes the surface of the image bearer to light in an imagewise manner.

The charging can be performed, for example, by applying a voltage to the surface of the image bearer with the use of the charger.

The charger is not particularly limited, and can be appropriately selected in accordance with the intended use. Examples thereof include a contact charger known per se including a conductive or semiconductive roll, a brush, a film, a rubber blade, and the like, and a non-contact charger that uses corona discharge such as corotron and scorotron. The charger preferably includes a voltage applying unit that applies a voltage including an alternating component.

The exposure can be performed, for example, by exposing the surface of the image bearer in an imagewise manner with the use of the exposure device.

The exposure device is not particularly limited as long as the surface of the image bearer charged by the charger can be exposed to light in an imagewise manner, and can be appropriately selected in accordance with the intended use. Examples of the exposure device include various exposure devices such as a copying optical system, a rod lens array system, a laser optical system, and a liquid crystal shutter optical system. It is to be noted that, in the present invention, a back-exposure method may be employed in which exposure is performed in an imagewise manner from the back side of the image bearer.

Developing Step and Developing Unit

The developing step is a step of developing the electrostatic latent image with the use of a toner or a developer to form a visualized toner image. The visualized toner image can be formed, for example, by developing the electrostatic latent image with the use of the toner or the developer, and can be formed by the developing unit.

The developing unit is not particularly limited as long as developing can be performed with the use of, for example, the toner or the developer, and can be appropriately selected from known developing units. Preferred examples of the developing units include a developing unit at least including a developing device that stores the toner or the developer stored and can apply the toner or the developer to the electrostatic latent image in a contact or non-contact manner.

Toner

Average Circularity and Average Particle Diameter

The toner preferably has an average circularity of 0.90 to 1.00, more preferably 0.93 to 1.00, even more preferably 0.95 to 0.99, which is an average value for the circularity SR represented by the following formula 1. This average circularity is an indicator of the degree of toner particle irregularity, which indicates 1.00 in the case where the toner has a perfect spherical shape, and the average circularity has a smaller value as the surface shape becomes more complicated.

Circularity SR=(perimeter of circle equal in area to projected area of toner particle)/(perimeter of projected image of toner particle) Mathematical Formula 1

With the average circularity in the range of 0.93 to 1.00, the toner particles have smooth surfaces, which are excellent in transferability because of the areas of contact between the toner particles and between the toner particles and the photoconductor. In addition, because the toner particles have no corners, the high stirring torque of the developer in the developing device stabilizes the stirring drive, thus generating no abnormal images. In addition, because the toner forming dots has no angular toner particles, the pressure is, in pressing the toner against a recording medium for transfer, uniformly applied to the entire toner forming the dots, thereby making transfer missing less likely to be caused. In addition, since the toner particles are not angular, the toner particles themselves are low in polishing power, without damaging or abrading the surface of the image bearer.

The circularity SR can be measured with the use of, for example, a flow-type particle image analyzer (FPIA-1000 from Toa Medical Electronics Co., Ltd.). First, to 100 to 150 ml of water with impure solid substances removed in advance in a container, 0.1 to 0.5 ml of a surfactant (preferably an alkylbenzene sulfonate) is added as a dispersant, and approximately 0.1 to 0.5 g of a measurement sample is further added. The suspension in which the sample is dispersed is subjected to a dispersion treatment for about 1 to 3 minutes with an ultrasonic disperser, and the shape and particle size of the toner are measured with the analyzer at a dispersion liquid concentration of 3000 to 10000 particles/W.

The mass average particle diameter (D4) of the toner is preferably 3 to 10 μm, more preferably 4 to 8 μm. In this range, the toner is excellent in dot reproducibility because of having toner particles that are sufficiently small in particle diameter with respect to minute latent image dots. The mass average particle diameter (D4) of less than 3 μm may make it likely to cause phenomena such as a decrease in transfer efficiency and a decrease in blade cleanability, whereas the mass average particle diameter (D4) in excess of 10 μm may make it difficult to keep characters and lines from scattering.

The ratio (D4/D1) of the mass average particle diameter (D4) of the toner to the number average particle diameter (D1) thereof is preferably 1.00 to 1.40, more preferably 1.00 to 1.30. The ratio (D4/D1) that is closer to 1 means that the toner has a shaper particle size distribution. The ratio (D4/D1) in the range of 1.00 to 1.40 causes no selective developing due to the toner particle diameter, thus resulting in excellent stability in image quality. In addition, the sharp particle size distribution of the toner makes the triboelectric charging amount distribution also sharp, and the occurrence of fogging is suppressed. In addition, when the toner is uniform in toner particle diameter, the latent image dots are developed so as to be arranged densely and orderly, thus resulting in excellent dot reproducibility.

In this regard, the mass average particle diameter (D4) and particle size distribution of the toner are measured by, for example, a Coulter counter method. Examples of the apparatus for measuring the particle size distribution of toner particles by the Coulter counter method include Coulter Counter TA-II and Coulter Multisizer II (both from Coulter, Inc.).

First, 0.1 to 5 ml of a surfactant (preferably an alkylbenzene sulfonate) is added as a dispersant to 100 to 150 ml of the electrolytic aqueous solution. In this regard, the electrolytic solution is obtained by preparing an about 1% NaCl aqueous solution with the use of a primary sodium chloride, and for example, ISOTON-II (from Coulter, Inc.) can be used. In this regard, 2 to 20 mg of a measurement sample is further added. The electrolytic solution in which the sample is suspended is subjected to a dispersion treatment for about 1 to 3 minutes with an ultrasonic disperser, and the volume and number of the toner particles or toner are measured by the measuring apparatus with the use of a 100 μm aperture as an aperture to calculate the volume distribution and the number distribution. From the obtained distributions, the mass average particle diameter (D4) and number average particle diameter (D1) of the toner can be determined.

As a channel, 13 channels of: 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm are used, and toner particles of 2.00 μm or more and less than 40.30 μm in particle diameter are subjected to the measurement.

The toner in such a substantially spherical shape can be prepared by developing a cross-linking and/or elongation reaction of a toner composition including a polyester prepolymer having a functional group containing a nitrogen atom, a polyester, a colorant, and a release agent in the presence of resin fine particles in an aqueous medium. The toner produced by this reaction has a toner surface subjected to curing, thereby allowing the generation of hot offset to be reduced, and allowing the toner to be prevented from contaminating a fixing device and then appearing on the image.

The volume average particle diameter (Dv) of the toner is preferably 4 μm to 10 μm. When the thickness is 4 μm or more, the image quality can be kept favorable, without interfering with the cleanability in the developing step and the transfer efficiency in the transfer step. When the thickness is 10 μm or less, fine line reproducibility of the image can be kept favorable.

Toner Material and Manufacturing Method

The toner for use in the present embodiment includes, for example, a binder resin, a colorant, and a release agent, and includes other components, as necessary.

For example, a polyester prepolymer, polyester, and the like can be used as the binder resin included in the toner. As the polyester prepolymer, a prepolymer including a modified polyester-based resin, the above-described polyester prepolymer having a functional group containing a nitrogen atom, and the like can be used.

Examples of the prepolymer including the modified polyester-based resin include a polyester prepolymer (A) having an isocyanate group, and examples of the compound that is elongated or cross-linked with the prepolymer include amines (B).

Examples of the polyester prepolymer (A) having an isocyanate group include a product obtained by reacting a polyester having a polycondensate of a polyol (1) and a polycarboxylic acid (2) and having an active hydrogen group, further with a polyisocyanate (3).

Examples of the active hydrogen group of the polyester include hydroxyl groups (an alcoholic hydroxyl group and a phenolic hydroxyl group), an amino group, a carboxyl group, and a mercapto group. Among these examples, an alcoholic hydroxyl group is particularly preferred.

Examples of the polyol (1) include a diol (1-1) and a tri- or higher-valent polyol (1-2), and the diol (1-1) alone or a mixture of the diol (1-1) and a small amount of the polyol (1-2) is preferred.

Examples of the diol (1-1) include alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. Among these examples, alkylene glycols having 2 to 12 carbon atoms and alkylene oxide adducts of bisphenols are preferred, and alkylene oxide adducts of bisphenols and combinations thereof with alkylene glycols having 2 to 12 carbon atoms are particularly preferred.

Examples of the tri- or higher-valent polyol (1-2) include tri- to octa- or higher-valent polyhydric aliphatic alcohols (e.g., glycerin, trimethylolethane, trimethylolpropane, pentaerythritol, sorbitol); tri- or higher-valent phenols (e.g., trisphenol PA, phenol novolac, cresol novolac); and alkylene oxide adducts of the tri- or higher-valent polyphenols.

Examples of the polycarboxylic acid (2) include a dicarboxylic acid (2-1) and a tri- or higher-valent polycarboxylic acid (2-2), and among these examples, the dicarboxylic acid (2-1) alone and a mixture of the dicarboxylic acid (2-1) and a small amount of the polycarboxylic acid (2-2) are preferred.

Examples of the dicarboxylic acid (2-1) include alkylene dicarboxylic acids (e.g., a succinic acid, an adipic acid, a sebacic acid); alkenylene dicarboxylic acids (e.g., a maleic acid, a fumaric acid); and aromatic dicarboxylic acids (e.g., a phthalic acid, an isophthalic acid, a terephthalic acid, a naphthalenedicarboxylic acid). Among these examples, an alkenylene dicarboxylic acid having 4 to 20 carbon atoms and an aromatic dicarboxylic acid having 8 to 20 carbon atoms are particularly preferred.

Examples of the tri- or higher-valent polycarboxylic acid (2-2) include aromatic polycarboxylic acids having 9 to 20 carbon atoms (e.g., a trimellitic acid, a pyromellitic acid). It is to be noted that as the polycarboxylic acid (2), an acid anhydride or a lower alkyl ester (e.g., a methyl ester, an ethyl ester, an isopropyl ester) from the examples described above may be used for a reaction with the polyol (1).

For the ratio of the polyol (1) to the polycarboxylic acid (2), the equivalent ratio [OH]/[COOH] of the hydroxyl group [OH] to the carboxyl group [COOH] is preferably 2/1 to 1/1, more preferably 1.5/1 to 1/1, even more preferably 1.3/1 to 1.02/1.

Examples of the polyisocyanate (3) include aliphatic polyisocyanates (e.g., tetramethylene diisocyanate, hexamethylene diisocyanate, 2,6-diisocyanatomethyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic aliphatic diisocyanates (e.g., α,α,α',α'-tetramethylxylylene diisocyanate); isocyanurates; and the polyisocyanates blocked with a phenol derivative, an oxime, a caprolactam, or the like. These examples may be used alone, or two or more thereof may be used in combination.

For the ratio of the polyisocyanate (3), the equivalent ratio [NCO]/[OH] of the isocyanate group [NCO] to the hydroxyl group [OH] of the polyester having the hydroxyl group is preferably 5/1 to 1/1, more preferably 4/1 to 1.2/1, even more preferably 2.5/1 to 1.5/1. When the equivalent ratio of [NCO]/[OH] exceeds 5, the low-temperature fixability may be degraded, and when the molar ratio of [NCO] is less than 1, the urea content in the modified polyester will be decreased, thereby degrading the hot offset resistance.

The content of the constituent for the polyisocyanate (3) in the prepolymer (A) having an isocyanate group at the terminal is preferably 0.5 to 40% by mass, more preferably 1 to 30% by mass, even more preferably 2 to 20% by mass. When the content is less than 0.5% by mass, the hot offset resistance will be degraded, and disadvantages will be brought in terms of balance between heat-resistant storage stability and low-temperature fixability. When the content exceeds 40% by mass, the low-temperature fixability may be degraded.

The number of isocyanate groups contained per molecule in the prepolymer (A) having the isocyanate groups is preferably 1 or more on average, more preferably 1.5 to 3 on average, even more preferably 1.8 to 2.5 on average. When the number is less than 1 per molecule, the molecular weight of the urea-modified polyester will be decreased, and the hot offset resistance may be degraded.

Examples of the amines (B) include a diamine (B1), a tri- or higher-valent polyamine (B2), an amino alcohol (B3), an amino mercaptan (B4), an amino acid (B5), and compounds (B6) obtained by blocking the amino groups of B1 to B5.

Examples of the diamine (B1) include aromatic diamines (e.g., phenylenediamine, diethyltoluenediamine, 4,4' diaminodiphenylmethane); alicyclic diamines (e.g., 4,4'-diamino-3,3' dimethyldicyclohexylmethane, diaminecyclohexane, isophoronediamine); and aliphatic diamines (e.g., ethylenediamine, tetramethylenediamine, hexamethylenediamine).

Examples of the tri- or higher-valent polyamine (B2) include a diethylenetriamine and a triethylenetetramine.

Examples of the amino alcohol (B3) include an ethanolamine and a hydroxyethylaniline.

Examples of the amino mercaptan (B4) include an aminoethyl mercaptan and an aminopropyl mercaptan.

Examples of the amino acid (B5) include an aminopropionic acid and an aminocaproic acid.

Examples of the compounds (B6) obtained by blocking the amino groups of B1 to B5 include ketimine compounds and oxazoline compounds obtained from the amines of B1 to B5 and ketones (e.g., acetone, methyl ethyl ketone, methyl isobutyl ketone).

Preferred among these amines (B) are the diamine B1 and a mixture of the diamine B1 and a small amount of the polyamine B2.

Furthermore, if necessary, the molecular weight of the urea-modified polyester can be adjusted with the use of an elongation terminator. Examples of the elongation terminator include monoamines (e.g., diethylamine, dibutylamine, butylamine, laurylamine), or compounds obtained by blocking the monoamines (ketimine compounds).

For the ratio of the amines (B), the equivalent ratio [NCO]/[NHx] of the isocyanate group [NCO] in the prepolymer (A) having the isocyanate group to the amino group [NHx] in the amines (B) is preferably 1/2 to 2/1, more preferably 1.5/1 to 1/1.5, even more preferably 1.2/1 to 1/1.2. When the ratio [NCO]/[NHx] is greater than 2 or less than 1/2, the molecular weight of the urea-modified polyester (i) will be decreased, and the hot offset resistance will be degraded.

In the present invention, a urethane bond may be contained together with a urea bond in the polyester (i) modified with the urea bond. The molar ratio of the urea bond content to the urethane bond content is preferably 100/0 to 10/90, more preferably 80/20 to 20/80, even more preferably 60/40 to 30/70. When the molar ratio of the urea bond is less than 10%, the hot offset resistance may be degraded.

These reactions allow the preparation of a modified polyester that is used for the toner, in particular, the urea-modified polyester (i). These urea-modified polyesters (i) are produced by a one-shot method or a prepolymer method. The mass average molecular weight of the urea-modified polyester (i) is preferably 10,000 or more, more preferably 20,000 to 10,000,000, and even more preferably 30,000 to 1,000,000. When the mass average molecular weight is less than 10,000, the hot offset resistance may be degraded.

The number average molecular weight of the urea-modified polyester is not to be considered particularly limited in the case of using an unmodified polyester (ii) as described later, and may be a number average molecular weight that can be easily obtained as the mass average molecular weight. In the case of the urea-modified polyester (i) alone, the number average molecular weight is preferably 20,000 or less, more preferably 1,000 to 10,000, even more preferably 2,000 to 8,000. When the number average molecular weight is greater than 20,000, the low-temperature fixability and the glossiness in the case of use in a full-color image forming apparatus may be degraded.

In the present invention, the polyester (i) modified with a urea bond can be not only used alone, but also together with the polyester (i), an unmodified polyester (ii) can be contained as a binder resin component. The use in combination with the unmodified polyester (ii) is more preferred than the use alone, because the combined use improves the low-temperature fixability and the glossiness in the case of use in a full-color image forming apparatus. Examples of the unmodified polyester (ii) include a polycondensate of the polyol (1) and the polycarboxylic acid (2), which is similar to the polyester component of the polyester (i), and preferred examples are also similar to those for the polyester (i). In addition, the unmodified polyester (ii) may be not only the unmodified polyester, but also may be modified with a chemical bond other than a urea bond, for example, may be modified with a urethane bond. The polyester (i) and the unmodified polyester (ii) are preferably at least partially compatible in terms of low-temperature fixability and hot offset resistance.

Accordingly, the polyester component of the polyester (i) and the unmodified polyester (ii) preferably have similar compositions. The ratio by mass between the polyester (i) and the unmodified polyester (ii) in the case of containing the unmodified polyester (ii) is preferably 5/95 to 80/20, more preferably 5/95 to 30/70, even more preferably 5/95 to 25/75, particularly preferably 7/93 to 20/80. When the ratio by mass of the polyester (i) is less than 5% by mass, the hot offset resistance will be degraded, and disadvantages may be brought in terms of balance between heat-resistant storage stability and low-temperature fixability.

The peak molecular weight of the unmodified polyester (ii) is preferably 1,000 to 30,000, more preferably 1,500 to 10,000, even more preferably 2,000 to 8,000. When the peak molecular weight is less than 1,000, the heat-resistant storage stability may be degraded. When the peak molecular weight exceeds 10,000, the low-temperature fixability may be degraded. The hydroxyl value of the unmodified polyester (ii) is preferably 5 or more, more preferably 10 to 120, even more preferably 20 to 80. When the hydroxyl value is less than 5, disadvantages may be brought in terms of balance between heat-resistant storage stability and low-temperature fixability. The acid value of the unmodified polyester (ii) is preferably 1 to 30, more preferably 5 to 20. Having the acid value tends to provide negative chargeability.

The glass transition temperature (Tg) of the binder resin is preferably 50 to 70° C., more preferably 55 to 65° C. When the glass transition temperature is lower than 50° C., the blocking during high-temperature storage of the toner may be degraded. When the glass transition temperature is higher than 70° C., the low-temperature fixability will be insufficient. Due to the coexistence of the urea-modified polyester resin, the toner for use in the present invention tends to have better heat-resistant storage stability even if the glass transition temperature is low, as compared with a known polyester-based toner.

As the storage elastic modulus of the binder resin, the temperature (TG') at which the storage elastic modulus is 10,000 dyne/cm$^2$ at a measurement frequency of 20 Hz is preferably 100° C. or higher, more preferably 110 to 200° C. When the temperature (TG') is lower than 100° C., the hot offset resistance may be degraded.

As the viscosity of the binder resin, the temperature (TO at which the viscosity is 1000 poise at a measurement frequency of 20 Hz is preferably 180° C. or lower, more preferably 90 to 160° C. When the temperature (TO exceeds 180° C., the low-temperature fixability will be degraded. More specifically, TG' is preferably higher than Tη from the viewpoint of achieving a balance between low-temperature fixability and hot offset resistance. In other words, the difference (TG'−Tη) between TG' and Tη is preferably more than 0° C., more preferably 10° C. or more, ever more preferably 20° C. or more. It is to be noted that the upper limit of the difference is not particularly limited. In addition, the difference between Tη and Tg is preferably 0 to 100° C., more preferably 10 to 90° C., even more preferably 20 to 80° C. from the viewpoint of achieving a balance between heat-resistant storage stability and low-temperature fixability.

The binder resin can be produced by the following method or the like.

First, the polyol (1) and the polycarboxylic acid (2) are heated to 150 to 280° C. in the presence of a known esterification catalyst such as a tetrabutoxy titanate or a dibutyltin oxide, and as necessary, under reduced pressure the produced water is distilled off to obtain a polyester having a hydroxyl group. Then, the polyisocyanate (3) is reacted therewith at 40 to 140° C. to obtain a prepolymer (A) having an isocyanate group. Furthermore, the amines (B) are reacted with the prepolymer (A) at 0 to 140° C. to obtain a polyester modified with a urea bond. In reacting the polyisocyanate (3) and reacting the prepolymer (A) and the amines (B), a solvent can be used, as necessary.

Examples of usable solvents include solvents that are inactive against isocyanate (3), such as aromatic solvents (e.g., toluene, xylene); ketones (e.g., acetone, methyl ethyl ketone, methyl isobutyl ketone); esters (e.g. ethyl acetate); amides (e.g., dimethylformamide, dimethylacetamide); and ethers (e.g., tetrahydrofuran).

In the case of using the polyester (ii) that is not modified with a urea bond in combination, the polyester (ii) is produced in the same manner as the polyester having a hydroxyl group, dissolved in the solution after completing the reaction of the polyester (i), and mixed.

It is to be noted that the binder resin other than the polyester resin is also not particularly limited, and can be appropriately selected in accordance with the intended use. Examples thereof include a homopolymer of styrene or a substitution product thereof, such as polystyrene, poly p-styrene, or polyvinyl toluene, styrene-based copolymers such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylic acid copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ether copolymer, a styrene-methyl vinyl ketone copolymer, a styrene-butadiene copolymer, a styrene-isopropyl copolymer, and a styrene-maleic acid ester copolymer, polymethyl methacrylate resins, polybutyl methacrylate resins, polyvinyl chloride resins, polyvinyl acetate resins, polyethylene resins, polyurethane resins, epoxy resins, polyvinyl butyral resins, polyacrylic acid resins, rosin resins, modified rosin resins, terpene resins, phenol resins, aliphatic or aromatic hydrocarbon resins, and aromatic petroleum resins. These examples may be used alone, or two or more thereof may be used in combination. Among these examples, the use of the polyester resins is particularly preferred in terms of affinity for a recording medium to be fixed.

The toner for use in the present invention can be produced by the following method, but obviously, the method is not limited.

The toner may be formed by reacting a dispersion including the prepolymer (A) having an isocyanate group with the amines (B) in an aqueous medium, or the urea-modified polyester (i) produced in advance may be used. Examples of the method for stably forming a dispersion including the urea-modified polyester (i) or the prepolymer (A) in an aqueous medium include a method of adding a composition of toner raw materials including the urea-modified polyester (i) or the prepolymer (A) into an aqueous medium and dispersing the composition with a shear force.

The prepolymer (A), and the other toner composition (which may be hereinafter referred to as toner raw materials) such as a colorant, a colorant masterbatch, a release agent, a charging control agent, and an unmodified polyester resin may be mixed in the formation of a dispersion in an aqueous medium, but it is more preferable to mix the toner raw materials in advance and then add and disperse the mixture into an aqueous medium. In addition, in the present invention, there is not necessarily a need for the other toner raw materials such as a colorant, a release agent, and a charging control agent to be mixed in the formation of particles in an aqueous medium, and the materials may be added after forming the particles. For example, after forming particles containing no colorant, a colorant can be added by a known dyeing method.

The aqueous medium may be water alone, or a solvent that is miscible with water may be used in combination. Examples of the miscible solvent include alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The amount of the aqueous medium used with respect to 100 parts by mass of the toner composition including the urea-modified polyester (i) and the prepolymer (A) is preferably 50 to 2000 parts by mass, more preferably 100 to 1000 parts by mass. When the amount used is less than 50 parts by mass, the poor dispersion state of the toner composition may result in a failure to obtain toner particles that have a predetermined particle diameter. The amount in excess of 2000 parts by mass is not economical.

In addition, a dispersant can also be used, as necessary. The use of a dispersant is preferred in terms of sharp particle size distribution and stable dispersion.

The method for dispersion is not particularly limited, and can be appropriately selected in accordance with the intended use. For example, known equipment can be applied, such as a low-speed shearing type, a high-speed shearing type, a friction type, a high-pressure jet type, and an ultrasonic wave. For the particle diameter of the dispersion from 2 to 20 μm, a high-speed shearing type is preferred. In the case of using a high-speed shearing type disperser, the revolution speed is not particularly limited, but is preferably 1000 to 30000 rpm, more preferably 5000 to 20000 rpm.

The dispersion time is not particularly limited, but is typically 0.1 to 5 minutes in the case of a batch method. The temperature for dispersion is typically preferably 0 to 150° C., more preferably 40 to 98° C. The temperature is preferably higher in that the viscosity of the dispersion including the urea-modified polyester (i) or the prepolymer (A) is lower, and more easily dispersed.

In the step of synthesizing the urea-modified polyester (i) from the prepolymer (A), the amines (B) may be added and then reacted before the toner composition is dispersed in the aqueous medium, or the amines (B) may be added and reacted from the particle interfaces after the toner composition is dispersed in the aqueous medium. In this case, a urea-modified polyester is preferentially produced on the surface of the toner to be produced, and a concentration gradient can be also provided inside the particles.

In the reaction, a dispersant is preferably used, as necessary. The dispersant is not particularly limited, and can be appropriately selected in accordance with the intended use, and examples thereof include surfactants, poorly water-soluble inorganic compound dispersants, and polymeric protective colloids. These examples may be used alone, or two or more thereof may be used in combination. Among these examples, the surfactants are preferred.

Examples of the surfactants include anionic surfactants, cationic surfactants, nonionic surfactants, and amphoteric surfactants.

Examples of the anionic surfactants include alkylbenzene sulfonates, α-olefin sulfonates, and phosphates, and among these examples, anionic surfactants having a fluoroalkyl group are preferred.

Examples of the anionic surfactants having a fluoroalkyl group include a fluoroalkyl carboxylic acid having 2 to 10 carbon atoms or a metal salt thereof, disodium perfluorooctanesulfonylglutamate, sodium 3-[omega-fluoroalkyl (6 to 11 carbon atoms) on]-1 alkyl (3 to 4 carbon atoms) sulfonate, sodium 3-[omega-fluoroalkanoyl (6 to 8 carbon atoms) —N-ethylamino]-1 propanesulfonate, a fluoroalkyl (11 to 20 carbon atoms) carboxylic acid or a metal salt thereof, a perfluoroalkyl carboxylic acid (7 to 13 carbon atoms) or a metal salt thereof, a perfluoroalkyl (4 to 12 carbon atoms) sulfonic acid or a metal salt thereof, diethanolamide perfluorooctane sulfonate, N-propyl-N-(2-hydroxyethyl)perfluorooctane sulfonamide, a perfluoroalkyl (6 to 10 carbon atoms) sulfonamide propyl trimethylammonium salt, a perfluoroalkyl (6 to 10 carbon atoms) —N-ethylsulfonylglycine salt, and a monoperfluoroalkyl (6 to 16 carbon atoms) ethyl phosphate.

Examples of commercially available products of the surfactants having a fluoroalkyl group include Surflon S-111, S-112, and S-113 (from ASAHI GLASS CO., LTD.); Fluorad FC-93, FC-95, FC-98, and FC-129 (from Sumitomo 3M Limited); Unidyne DS-101 and DS-102 (from DAIKIN INDUSTRIES, LTD.); Megafac F-110, F-120, F-113, F-191, F-812, and F-833 (from DAINIPPON INK & CHEMICALS, INC.); ECTOP EF-102, 103, 104, 105, 112, 123A, 123B, 306A, 501, 201, and 204 (from Tochem Products Co., Ltd.); and FTERGENT F-100 and F-150 (from NEOS COMPANY LIMITED).

Examples of the cationic surfactants include amine salt-type surfactants and quaternary ammonium salt-type cationic surfactants.

Examples of the amine salt-type surfactants include alkylamine salts, amino alcohol fatty acid derivatives, polyamine fatty acid derivatives, and imidazoline.

Examples of the quaternary ammonium salt-type cationic surfactants include alkyltrimethylammonium salts, dialkyldimethylammonium salts, alkyldimethylbenzylammonium salts, pyridinium salts, alkylisoquinolinium salts, and benzethonium chlorides.

Among the cationic surfactants, examples include aliphatic primary, secondary, or tertiary amine acids having a fluoroalkyl group, aliphatic quaternary ammonium salts such as perfluoroalkyl (6 to 10 carbon atoms) sulfonamide propyl trimethylammonium salts, benzalkonium salts, benzethonium chlorides, pyridinium salts, and imidazolinium salts.

Examples of commercially available product of the cationic surfactants include Surflon S-121 (from ASAHI GLASS CO., LTD.); Fluorad FC-135 (from Sumitomo 3M Limited); Unidyne DS-202 (from DAIKIN INDUSTRIES, LTD.), Megafac F-150 and F-824 (DAINIPPON INK & CHEMICALS, INC.); ECTOP EF-132 (from Tochem Products Co., Ltd.); and FTERGENT F-300 (from NEOS COMPANY LIMITED).

Examples of the nonionic surfactants include fatty acid amide derivatives and polyhydric alcohol derivatives.

Examples of the amphoteric surfactants include alanine, dodecyl di(aminoethyl)glycine, di(octylaminoethyl)glycine, and N-alkyl-N,N-dimethylammonium betaine.

Examples of the poorly water-soluble inorganic compound dispersants include a tricalcium phosphate, a calcium carbonate, a titanium oxide, colloidal silica, and hydroxyapatite.

Examples of the polymeric protective colloids include acids, (meth)acrylic monomers containing a hydroxyl group, vinyl alcohols or ethers from vinyl alcohols, esters from vinyl alcohols and compounds containing a carboxyl group, amide compounds or methylol compounds thereof, chlorides, homopolymers or copolymers such as those having a nitrogen atom or a heterocycle thereof, polyoxyethylene-based colloids, and celluloses.

Examples of the acids include an acrylic acid, a methacrylic acid, an α-cyanoacrylic acid, an α-cyanomethacrylic acid, an itaconic acid, a crotonic acid, a fumaric acid, a maleic acid, and a maleic anhydride.

Examples of the (meth)acrylic monomers containing a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxyproyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide.

Examples of the vinyl alcohols or ethers from the vinyl alcohols include a vinyl methyl ether, a vinyl ethyl ether, and a vinyl propyl ether.

Examples of the esters from the vinyl alcohols and the compounds containing a carboxyl group include a vinyl acetate, a vinyl propionate, and a vinyl butyrate.

Examples of the amide compounds or methylol compounds thereof include acrylamides, methacrylamides, diacetone acrylamide acids, and methylol compounds thereof.

Examples of the chlorides include acrylic acid chlorides and methacrylic acid chlorides.

Examples of the homopolymers or copolymers such as those having a nitrogen atom or a heterocycle thereof include vinylpyridine, vinylpyrrolidone, vinylimidazole, and ethyleneimine.

Examples of the polyoxyethylene-based colloids include a polyoxyethylene, a polyoxypropylene, a polyoxyethylene alkylamine, a polyoxypropylene alkylamine, a polyoxyethylene alkylamide, a polyoxypropylene alkylamide, a polyoxyethylene nonylphenyl ether, a polyoxyethylene laurylphenyl ether, a polyoxyethylene stearylphenyl ester, and a polyoxyethylene nonylphenyl ester.

Examples of the celluloses include a methyl cellulose, a hydroxyethyl cellulose, and a hydroxypropyl cellulose.

In the preparation of the dispersion liquid, a dispersion stabilizer can be used, as necessary. Examples of the dispersion stabilizer include those that can be dissolved in an acid or an alkali, such as a calcium phosphate salt.

In the case where the dispersion stabilizer is used, the calcium phosphate can be removed from the fine particles by a method of dissolving the calcium phosphate with an acid such as a hydrochloric acid and then washing with water, a method of decomposing the calcium phosphate with an enzyme, or the like.

In the preparation of the dispersion liquid, a catalyst for the elongation reaction to the cross-linking reaction can be used. Examples of the catalyst include a dibutyltin laurate and a dioctyltin laurate.

Furthermore, for lowering the viscosity of the toner composition, a solvent in which the urea-modified polyester (i) or the prepolymer (A) is soluble can be also used. The use of the solvent is preferred in that the particle size distribution is sharp. The solvent is preferably volatile from the viewpoint of easy removal.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These examples may be used alone, or two or more thereof may be used in combination. Among these examples, the aromatic solvents such as toluene and xylene; and the halogenated hydrocarbons such as methylene chloride, 1,2-dichloroethane, chloroform, and carbon tetrachloride are preferred, and the aromatic solvents such as toluene and xylene are more preferred.

The amount of the solvent used with respect to 100 parts by mass of the prepolymer (A) is preferably 0 to 300 parts by mass, more preferably 0 to 100 parts by mass, even more preferably 25 to 70 parts by mass. In the case where the solvent is used, the solvent is removed by heating under normal pressure or reduced pressure after the elongation and/or cross-linking reaction.

The elongation and/or cross-linking reaction time is selected depending on the reactivity achieved by the combination of the isocyanate group structure of the prepolymer (A) and the amines (B), and is typically preferably 10 minutes to 40 hours, more preferably 2 to 24 hours. The reaction temperature is preferably 0 to 150° C., more preferably 40 to 98° C. Furthermore, a known catalyst can be used, as necessary. Specific examples thereof include a dibutyltin laurate and a dioctyltin laurate.

For removing the organic solvent from the obtained emulsified dispersion, a method of gradually raising the temperature of the entire system to completely evaporate and remove the organic solvent in the droplets can be employed. In addition, it is also possible to spray the emulsified dispersion into a dry atmosphere to completely remove the water-insoluble organic solvent in the droplets and then form toner fine particles, and at the same time, to evaporate and remove the aqueous dispersant.

As the dry atmosphere in which the emulsified dispersion is sprayed, gases obtained by heating air, nitrogen, a carbon dioxide gas, a combustion gas, or the like, in particular, various types of air flows heated to a temperature that is equal to or higher than the boiling point of the highest boiling point solvent to be used, are typically used. The intended quality is adequately achieved by treatment for a short period of time with a spray dryer, a belt dryer, a rotary kiln, or the like.

In the case where washing and drying treatment are performed while keeping the broad particle size distribution during emulsification and dispersion, the particles can be classified into a desired particle size distribution to adjust the particle size distribution.

In the classification operation, the fine particle fraction can be removed with a cyclone, a decanter, centrifugation, or the like in the liquid. The classification operation may be performed after the particles are obtained as a powder after drying, but is preferably to performed in the liquid in terms of efficiency. The obtained unnecessary fine particles or coarse particles can be returned to the kneading step again, and then used for particle formation. In that regard, the unnecessary fine particles or coarse particles may be wet. The used dispersant is preferably removed as much as possible from the obtained dispersion liquid, preferably simultaneously with the classification operation described above.

Mixing the powder of the obtained dried toner along with different types of particles such as release agent fine particles, charging-controllable fine particles, fluidizing agent fine particles, and colorant fine particles, and applying a mechanical impact force to the mixed powder achieve immobilization and fusion on the surface, thereby making it possible to prevent detachment of the different types of particles from the surfaces of the obtained composite particles.

Specific means include (1) a method of applying an impact force to the mixture with a blade rotating at a high speed, and (2) a method of putting the mixture into a high-speed air flow to accelerate the mixture and cause the particles or composite particles to collide with an appropriate collision plate.

Examples of the apparatus include an apparatus that has an Angmill (from Hosokawa Micron Corporation) and an I-type mill (from Nippon Pneumatic Mfg. Co., Ltd.) modified to reduce the grinding air pressure, a hybridization system (from Nara Machinery Co., Ltd.), a Kryptron system (from Kawasaki Heavy Industries, Ltd.), and an automatic mortar.

As the colorant for use in the toner, pigments and dyes conventionally used as colorants for toners can be used, and as for the color given, colorants that give a color such as black, yellow, magenta, or cyan can be used. Further, it is preferable to form a full-color image with the use of at least four colors of black, yellow, magenta, and cyan.

The colorant is not particularly limited, and can be appropriately selected from among known dyes and pigments in accordance with the intended use. Specifically, carbon black, lampblack, iron black, ultramarine blue, nigrosine dye, aniline blue, phthalocyanine blue, phthalocyanine green, Hansa yellow G, rhodamine 6C lake, calco oil blue, chromium yellow, quinacridone red, benzidine yellow, rose bengal, and the like can be used alone or in combination.

The content of the colorant is not particularly limited, and can be appropriately selected in accordance with the intended use. For example, the content is preferably 1 part by mass to 15 parts by mass, more preferably 3 parts by mass to 10 parts by mass with respect to 100 parts by mass of the toner.

The colorant may be used as a masterbatch combined with a resin. The resin is not particularly limited, and can be appropriately selected from among known resins in accordance with the intended use. Examples thereof include polymers of styrene or substitution products thereof, styrene-based copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosins, modified rosins, terpene resins, aliphatic hydrocarbon resins, alicyclic hydrocarbon resins, aromatic petroleum resins, chlorinated paraffin, and paraffin. These examples may be used alone, or two or more thereof may be used in combination.

Furthermore, if necessary, for imparting a magnetic property to the toner particles themselves, for example, known magnetic components such as iron oxides such as ferrite, magnetite, and maghemite; and metals such as iron, cobalt, and nickel or alloys of these metals and other metals may be contained alone or in mixture in the toner particles. These components can also be used as colorant components.

The content of the magnetic substance is not particularly limited, and can be appropriately selected in accordance with the intended use. For example, the content is preferably 10 parts by mass to 200 parts by mass, more preferably 20 parts by mass to 150 parts by mass with respect to 100 parts by mass of the binder resin.

In addition, the number average particle diameter of the colorant in the toner for use in the present invention is preferably 0.5 μm or less, more preferably 0.4 μm or less, even more preferably 0.3 μm or less. When the number average particle diameter exceeds 0.5 μm, the dispersibility of the pigment fails to reach a sufficient level, and preferred transparency may fail to be achieved. In contrast, the colorant with fine particle diameters smaller than 0.1 μm in number average particle diameter is sufficiently smaller than a half wavelength of visible light, and thus believed not to adversely affect reflection and absorption characteristics of light. Accordingly, the particles of the colorant with the number average particle diameter less than 0.1 μm contribute to favorable color reproducibility and the transparency of an OHP sheet with a fixed image. In contrast, the presence of a large amount of colorant that has particle diameters with the number average particle diameter larger than 0.5 μm tends to block or scatter transmission of incident light, thereby decreasing the brightness and saturation of the projected image of the OHP sheet. Furthermore, the presence of a large amount of colorant with particle diameters larger than 0.5 μm may cause detachment of the colorant from the toner particle surfaces, thereby causing various disadvantages such as fogging, drum contamination, and defective cleaning.

The colorant that has particle diameters with the number average particle diameter larger than 0.7 μm is preferably 10% by number or less, more preferably 5% by number or less of all of the colorants.

In addition, the colorant is preferably kneaded together with some or all of the binder resin in advance with a wetting liquid added. In this case, with the binder resin and the colorant initially adhering sufficiently, the colorant is more effectively dispersed in the toner particles in the subsequent toner production process. Thus, the dispersed particle diameters of the colorant are reduced, thereby allowing more favorable transparency to be achieved. As the binder resin for use in the kneading in advance, the resins illustrated as the binder resin for the toner can be used as they are, but not to be considered limited thereto.

Examples of a specific method for kneading the mixture of the binder resin and the colorant in advance together with the wetting liquid include a method of mixing the binder resin, the colorant, and the wetting liquid with a blender such as a Henschel mixer, and then kneading the obtained mixture at a temperature that is lower than the softening temperature of the binder resin with a kneader such as a two-roll or three-roll kneader.

As the wetting liquid, common wetting liquids can be used in consideration of the solubility of the binder resin and the wettability thereof to the colorant. For example, organic solvents such as acetone, toluene, or butanone, and water are preferred in terms of the dispersibility of the colorant. Among these solvents, the use of water is particularly preferred in terms of environmental consideration and maintaining the dispersion stability of the colorant in the subsequent toner production process.

This production method not only reduces the particle diameters of the colorant particles contained in the toner to be obtained, but also enhances the uniformity of the dispersion state of the particles, thus further improving the color reproducibility of the projected image from the OHP.

The toner contains a wax (release agent) in the toner for providing releasability together with the binder resin and the colorant. The wax has a melting point of preferably 40 to 160° C., in particular, 50 to 120° C. When the melting point is lower than 40° C., the heat-resistant storage stability may be adversely affected. When the melting point exceeds 160° C., cold offset may be more likely to be caused in fixing at a low temperature.

The melt viscosity of the wax is preferably 5 to 1000 cps, more preferably 10 to 100 cps at a temperature that is 20° C. higher than the melting point. When the melt viscosity exceeds 1000 cps, the effect of improving the hot offset resistance and the low-temperature fixability may be poorly enhanced.

The content of the wax in the toner is preferably 0 to 40% by mass, more preferably 3 to 30% by mass. When the content of the wax exceeds 40% by mass, the excessively large amount of the wax deposited on the image surface after the fixing step may repel the ultraviolet-curable composition and ultraviolet-curable pressure-sensitive composition described later, or hinder the adhesion at the interface between the toner and the ultraviolet-curable composition and ultraviolet-curable pressure-sensitive composition. It is to be noted that in the present invention, the toner containing the wax can be favorably removable.

Examples of the wax can include animal-derived waxes (e.g., beeswax, spermaceti, shellac wax), plant-derived waxes (e.g., carnauba wax, Japan wax, rice bran wax, candelilla wax), mineral-derived waxes (e.g., montan wax, ozokerite), petroleum-derived waxes (e.g., paraffin wax, microcrystalline wax), and ester waxes that have an ester bond produced from a long chain fatty acid having 10 to 12 or more carbon atoms and an aliphatic alcohol having 8 or more carbon atoms. Paraffin waxes, microcrystalline wax, and ester waxes, which are high in releasability and stable in terms of quality, are preferred. In particular, the ester waxes are preferred, because the ester waxes will not extremely hinder the adhesion at the interface of the ultraviolet-curable composition and ultraviolet-curable pressure-sensitive composition, thus improving the adhesion between the toner image and the ultraviolet-curable composition, and allowing favorable removability to be provided even in storage under high humidity.

For the wax, two or more waxes may be used in mixture. In particular, mixing waxes that differ in melting point is preferred, because the melting point of the wax as a whole is lowered, thus improving the releasability.

In addition, for early achieving the amount and rise of toner charging, the toner may contain therein a charging control agent, as necessary. Because the use of a colored material as the charging control agent causes a change in color, a colorless or nearly white material is preferred.

The charging control agent is not particularly limited, may an agent that imparts either positive or negative chargeability, and can be appropriately selected from among known agents in accordance with the intended use. Examples thereof include triphenylmethane-based dyes, molybdic acid chelate pigments, rhodamine-based dyes, alkoxy-based amines, quaternary ammonium salts (including fluorine-modified quaternary ammonium salts), alkylamides, elemental substances or compounds of phosphorus, elemental substances or compounds of tungsten, fluorine-based activators, metal salts of salicylic acids, and metal salts of salicylic acid derivatives.

As the charging control agent, commercially available products can be used. Examples of the commercially available products include BONTRON P-51 of a quaternary ammonium salt, E-82 of an oxynaphthoic acid-based metal complex, E-84 of a salicylic acid-based metal complex, and E-89 of a phenolic condensate (all from ORIENT CHEMICAL INDUSTRIES CO., LTD.); TP-302 and TP-415 of quaternary ammonium salt molybdenum complexes (all from Hodogaya Chemical Co., Ltd.); Copy Charge PSY VP 2038 of a quaternary ammonium salt, Copy Blue PR of a triphenylmethane derivative, Copy Charge NEG VP 2036 and Copy Charge NX VP 434 of quaternary ammonium salts (all of from Hoechst); and LRA-901 and LR-147 of a boron complex (all from by Japan Carlit Co., Ltd.), quinacridone, azo-pigments, and other polymeric compounds having a functional group such as a sulfonic acid group, a carboxyl group, or a quaternary ammonium salt.

The amount of the charging control agent added varies depending on the type of the binder resin, the presence or absence of any additive, the toner production method including the dispersion method, and the like, and fails to be unambiguously defined, but is preferably 0.1 to 10 parts by mass, more preferably 0.2 to 5 parts by mass with respect to 100 parts by mass of the binder resin. The added amount in excess of 10 parts by mass may excessively increase the chargeability of the toner, dampen the effect of the charging control agent, and increase the electrostatic attraction force on a developing roller, thereby leading to a decrease in the fluidity of the developer or a decrease in image density.

These charging control agents can be melt-kneaded together with the masterbatch and the resin, and then dissolved and dispersed, may be directly dissolved in an organic solvent and added for dispersion, or may be immobilized on the surface of the toner after preparation of toner particles.

In dispersing the toner composition in an aqueous medium in the toner production process, resin fine particles mainly for dispersion stabilization may be added.

For the resin fine particles, any resin can be used as long as the resin can form an aqueous dispersion, and may be a thermoplastic resin or a thermosetting resin. Examples thereof include vinyl-based resins, polyurethane resins, epoxy resins, polyester resins, polyamide resins, polyimide resins, silicon-based resins, phenol resins, melamine resins, urea resins, aniline resins, ionomer resins, and polycarbonate resins. These examples may be used alone, or two or more thereof may be used in combination. Among these examples, vinyl-based resins, polyurethane resins, epoxy resins, polyester resins, or combinations thereof are preferred from the viewpoint of easily obtaining an aqueous dispersion of fine spherical resin particles.

As the vinyl-based resins, for example, a polymer obtained by homopolymerization or copolymerization of a vinyl-based monomer is used. Examples thereof include styrene-(meth)acrylic acid ester resins, styrene-butadiene copolymers, (meth)acrylic acid-acrylic acid ester polymers, styrene-acrylonitrile copolymers, styrene-maleic anhydride copolymers, and styrene-(meth)acrylic acid copolymers.

As an external additive for aiding the fluidity, developability, and chargeability of the toner particles, inorganic fine particles are suitable. Examples of the inorganic fine particles include silica, alumina, titanium oxides, barium titanates, magnesium titanates, calcium titanates, strontium titanates, zinc oxides, tin oxides, silica sand, clay, mica, wollastonite, diatomaceous earth, chromium oxides, cerium oxides, red iron oxide, antimony trioxides, magnesium oxides, zirconium oxides, barium sulfates, barium carbonates, calcium carbonates, silicon carbides, and silicon nitrides.

The primary particle diameters of the inorganic fine particles are preferably 5 nm to 2 μm, more preferably 5 nm to 500 nm. In addition, the specific surface area of the inorganic fine particles, measured by a BET method, is preferably 20 to 500 $m^2/g$. The amount of the inorganic fine particles added in the toner is preferably 0.01 to 5% by mass, more preferably 0.01 to 2.0% by mass.

Examples of other polymeric fine particles include polymer particles obtained by soap-free emulsion polymerization, suspension polymerization, or dispersion polymerization, from polystyrenes, methacrylic acid ester and acrylic acid ester copolymers, silicon, benzoguanamine, polycondensation systems such as nylons, or thermosetting resins.

In addition, a fluidizing agent can also be added to the toner. The fluidizing agent can be subjected to a surface treatment to increase the hydrophobicity and prevent degradation of flow characteristics and charging characteristics even under high humidity. Examples of the fluidizing agent include silane coupling agents, silylating agents, silane coupling agents having an alkyl fluoride group, organic titanate-based coupling agents, aluminum-based coupling agents, silicon oils, and modified silicon oils.

Examples of the cleanability improver for removing a developer after transfer, remaining on a photoconductor and an intermediate transfer body, include metal salts of fatty acids such as zinc stearates, calcium stearates, and stearic acids; and polymer fine particles produced by soap-free emulsion polymerization or the like, such as polymethyl methacrylate fine particles and polystyrene fine particles. The polymer fine particles preferably have a relatively narrow particle size distribution and a volume average particle diameter of 0.01 to 1 μm.

The use of such a toner makes it possible to form a high-quality toner image, which is excellent developing stability as described above.

In addition, the image forming apparatus according to an embodiment of the present invention can be applied not only to the use in combination with the toner obtained by the polymerization method, which is composed to be suitable for obtaining high-quality images as described above, but also to amorphous toners obtained by grinding methods, and also in this case, the apparatus life can be significantly extended. As a material constituting the toner obtained by such a grinding method, typically, materials for use as an electrophotographic toner can be applied without particular limitation.

Examples of the binder resin for use in the toner obtained by the grinding method include monopolymers of styrene or a substitution product thereof, such as polystyrene, poly p-chlorostyrene, and polyvinyl toluene; styrene-based copolymers such as styrene/p-chlorostyrene copolymers, styrene/propylene copolymers, styrene/vinyltoluene copolymers, styrene/vinylnaphthalene copolymers, styrene/methyl acrylate copolymers, styrene/ethyl acrylate copolymers, styrene/butyl acrylate copolymers, styrene/octyl acrylate copolymers, styrene/methyl methacrylate copolymer, styrene/ethyl methacrylate copolymer, styrene/butyl methacrylate copolymers, styrene/methyl α-chloromethacrylate copolymers, styrene/acrylonitrile copolymers, styrene/methyl vinyl ketone copolymers, styrene/butadiene copolymers, styrene/isoprene copolymers, and styrene/maleic acid copolymers; acrylic acid ester-based monopolymers such as polymethyl acrylates, polybutyl acrylates, polymethyl methacrylates, and polybutyl methacrylates, or copolymers thereof; polyvinyl derivatives such as polyvinyl chloride and polyvinyl acetate; and polyester-based polymers, polyurethane-based polymers, polyamide-based polymers, polyimide-based polymers, polyol-based polymers, epoxy-based polymers, terpene-based polymers, aliphatic or alicyclic hydrocarbon resins, and aromatic petroleum resins. These examples may be used alone, or two or more thereof may be used in combination. Among these examples, styrene-acrylic copolymer resins, polyester-based resins, and polyol-based resins are preferred in terms of electrical characteristics, cost, and the like, and furthermore, polyester-based resins and polyol-based resins are particularly preferred as having favorable fixing characteristics.

For the toner obtained by the grinding method, the colorant component, wax component, charging control component, and the like as described above together with these resin components may be premixed as necessary, then kneaded around the softening temperature of the resin component or lower, cooled, and then subjected to grinding and classification steps to prepare a toner, and the external component may be appropriately added and mixed, as necessary.

Examples of the melt-kneading machine include a single-screw continuous kneader, a twin-screw continuous kneader, and a batch-type kneading machine including a roll mill. For example, a KTK-type twin-screw extruder from Kobe Steel, Ltd., a TEM-type extruder from Toshiba Machine Co., Ltd., a twin-screw extruder from KCK Engineering Co., Ltd., a PCM-type twin-screw extruder from Ikegai Iron Works Co., Ltd., a co-kneader from Buss, and the like are suitably used.

This melt-kneading is preferably performed under a proper condition such that the binder resin has no molecular chain broken. Specifically, the melt-kneading temperature is determined with reference to the softening point of the binder resin, and the breakage may be severely caused if the temperature is excessively higher than the softening point, whereas the dispersion may be kept from proceeding if the temperature is excessively lower.

In the grinding, the kneaded product obtained by the kneading is subjected to the grinding. In this grinding, first, the kneaded product is subjected to coarse grinding, and then to fine grinding. In this regard, a method is preferably used in which the product is subjected to grinding by colliding with a collision plate in a jet stream, grinding by colliding with particles each other in a jet stream, or grinding in a narrow gap between a mechanically rotating rotor and a stator.

For the classification, the ground product obtained by the grinding is classified to adjust the particles for a predetermined particle diameter. The classification can be performed by removing the fine particle fraction, for example, with a cyclone, a decanter, centrifugation, or the like.

After completing the grinding and the classification, the ground product is classified into an air flow by a centrifugal force or the like to produce a toner with a predetermined particle diameter.

Besides, the toner can also be produced by a suspension polymerization method or an emulsion polymerization method.

In the suspension polymerization method, a colorant, a wax, and the like are dispersed in an oil-soluble polymerization initiator and a polymerizable monomer, and the dispersion is emulsified and dispersed by an emulsification method described later in an aqueous medium containing a surfactant, and additionally, a solid dispersant and the like. Thereafter, a polymerization reaction is developed to form particles, thereby providing the toner.

As the polymerizable monomer, for example, an acid such as an acrylic acid, a methacrylic acid, an α-cyanoacrylic acid, an α-cyanomethacrylic acid, an itaconic acid, a crotonic acid, a fumaric acid, a maleic acid, or a maleic anhydride, an acrylamide, a methacrylamide, a diacetone acrylamide, or a methylol compound thereof, vinylpyridine, vinylpyrrolidone, vinylimidazole, ethyleneimine, or an acrylate or a methacrylate having an amino group, such as a dimethylaminoethyl methacrylate can be partially used to introduce a functional group onto the toner particle surface.

In addition, the selection of a dispersant having an acid group or a basic group as a dispersant to be used allows the dispersant to adsorb and remain on the toner surface, thereby introducing a functional group.

As the emulsion polymerization method, a water-soluble polymerization initiator and a polymerizable monomer are emulsified in water with the use of a surfactant, and subjected to a latex synthesis in accordance with a common emulsion polymerization approach. Separately, a dispersion that has a colorant, a wax, and the like dispersed in an aqueous medium is prepared, mixed, thereafter, condensed to a toner size, and heated and then fused to obtain a toner. The use of, as the latex, the same monomer as that for use in the suspension polymerization method allows a functional group to be introduced onto the surface of the toner.

Developing Device

The developing device may be a dry developing-type or wet developing type-device, and may be a monochromatic developing device or a multicolor developing device. Preferred examples thereof include a developing device including a stirrer that frictionally stirs and charges the toner or the developer, and a rotatable magnet roller.

In the developing device, for example, the toner and the carrier are mixed and stirred, and the toner is then charged by the friction, and kept napped on the surface of the rotating magnet roller to form a magnetic brush.

The magnet roller is disposed near the image bearer (photoconductor), and the toner constituting the magnetic brush formed on the surface of the magnet roller thus partially moves to the surface of the image bearer (photoconductor) by an electric attraction force. As a result, the electrostatic latent image is developed with the toner to form a visible image with the toner (toner image) on the surface of the image bearer (photoconductor).

The developer to be stored in the developing device is a developer including the toner, but the developer may be a one-component developer or a two-component developer.

Transfer Step and Transfer Unit

The transfer step is a step of transferring the toner image to a recording medium. Although not particularly limited, an aspect is preferred in which with the use of an intermediate transfer body, a toner image is primarily transferred onto the intermediate transfer body, and then secondarily transferred onto the recording medium. More preferred is an aspect including a primary transfer step of transferring a toner image onto an intermediate transfer body to form a composite transferred image with the use of two or more colors, preferably a full-color toner as the toner, and a secondary transfer step of transferring the composite transferred image onto the recording medium.

The toner image can be transferred, for example, by charging the image bearer (photoconductor) with the use of a transfer charger, and can be transferred by the transfer unit. Preferred as the transfer unit is an aspect including a primary transfer unit that transfers a visible image onto an intermediate transfer body to form a composite transferred image, and a secondary transfer unit that transfers the composite transferred image onto the recording medium.

It is to be noted that the intermediate transfer body is not particularly limited, and can be appropriately selected from known transfer bodies in accordance with the intended use, and preferred examples thereof include a transfer belt.

The intermediate transfer body preferably exhibits conductivity of $1.0\times10^{5}$ to $1.0\times10^{11}$ Ω·cm in volume resistance. In the case of the volume resistance below $1.0\times10^{5}$ Ω·cm, so-called transfer dust particles that disturb the toner image with discharge may be generated in transferring the toner image from the photoconductor onto the intermediate transfer body. In the case of the volume resistance in excess of $1.0\times10^{11}$ Ω·cm, after the toner image is transferred from the intermediate transfer body to the recording medium such as paper, the counter charge of the toner image may remain on the intermediate transfer body and appear as an afterimage on the next image.

As the intermediate transfer body, for example, belt-type or cylindrical plastics can be used, which are obtained by kneading a metal oxide such as a tin oxide or an indium oxide, conductive particles such as carbon black, or conductive polymers alone or in combination with a thermoplastic resin, and then extruding the kneaded mixture. In addition, an intermediate transfer body on an endless belt can be also obtained by adding the above-described conductive particles or conductive polymers as necessary to a resin liquid including a thermally cross-linkable monomer or oligomer, and performing centrifugal molding while heating.

The intermediate transfer body may be provided with a surface layer, and the resistance is preferably adjusted appropriately with the use of a conductive substance.

The transfer unit (the primary transfer unit and the secondary transfer unit) preferably includes at least a transfer device that removes and charges the visible image formed on the image bearer (photoconductor) toward the recording medium. The number of the transfer means may be one, or may be two or more.

Examples of the transfer device include a device for corona transfer by corona discharge, a transfer belt, a transfer roller, a pressure transfer roller, and an adhesive transfer device.

In the transfer unit, the voltage applied for transfer may be a direct-current voltage or an alternate-current voltage that applies a superimposition bias with an alternate-current component superimposed on a direct-current component and with the polarity alternately switched. Such transfer is also referred to as AC transfer.

In particular, in the secondary transfer unit, the application of an alternate-current voltage generates an appropriate gap in the toner image transferred to the recording medium side, thus allowing a region of the toner image flat part of the solid part of the multicolor image to have a size of 200 μm or less.

Recording Medium

The recording medium is not particularly limited, and can be appropriately selected from among known recording media (recording paper). In consideration of use as direct mails, the recording medium itself is preferably white, and coated paper is preferred where the surface of the recording medium has a coat layer of a white pigment such as calcium carbonate, talc, or kaolin.

The size of the white pigment is 0.1 μm or more, preferably 0.5 to 5 μm in average particle diameter. When the average particle diameter of the white pigment is less than 0.1 μm, the strength of the white pigment layer is extremely low, the white pigment has powder severely falling off and has a layer severely cracked, and the image is more likely to be peeled in re-peeling the medium again.

The thickness of the white pigment layer is preferably 1 μm or more, preferably 1.5 to 3 μm or more for maintaining the good appearance of the information sheet.

Fixing Step and Fixing Unit

The fixing step is a step of fixing the toner image transferred to the recording medium with the use of the fixing unit, and may be performed every time the toner of each color is transferred to the recording medium, or may be simultaneously performed at a time for the toners of respective colors laminated.

The fixing unit is not particularly limited, and known heating and pressurizing units can be used. Examples of the heating and pressurizing units include a combination of a heating roller and a pressurizing roller, and a combination of a heating roller, a pressurizing roller, and an endless belt.

The heating and pressurization in the fixing unit preferably cause the toner particles to fall within the range of $10^3$ Pa·s or more and $10^4$ Pa·s or less.

Other Steps and Other Means in Toner Image Forming Step

Other steps such as a neutralizing step, a cleaning step, a recycling step, and a controlling step may be included, as necessary. In addition, other units such as a neutralizing unit, a cleaning unit, a recycling unit, and a controlling unit may be included, as necessary.

The neutralizing step is a step of applying a neutralizing bias to the image bearer to perform neutralization, and can be suitably performed by a neutralizing unit. The neutralizing unit is not particularly limited, as long as a neutralizing bias can be applied to the image bearer, and can be appropriately selected from among known neutralizing devices, and preferred examples thereof include a neutralizing lamp.

The cleaning step is a step of removing the toner remaining on the image bearer, and can be suitably performed by a cleaning unit. The cleaning unit is preferably provided downstream of the transfer unit and upstream of the charger.

The cleaning unit is not particularly limited, as long as the toner remaining on the image bearer can be removed, and can be appropriately selected from among known cleaners. Preferred examples thereof include a magnetic brush cleaner, an electrostatic brush cleaner, a magnetic roller cleaner, a blade cleaner, a brush cleaner, and a web cleaner.

The recycling step is a step of recycling the toner removed in the cleaning step to the developing unit, and can be suitably performed by a recycling unit. The recycling unit is not particularly limited, and examples thereof include known conveying units.

The controlling step is a step of controlling each of the steps, and can be suitably performed by a controlling unit. The controlling means is not particularly limited as long as the movement of each unit can be controlled, and can be appropriately selected in accordance with the intended use, and examples thereof include devices such as a sequencer and a computer.

Applying Step and Applying Unit and Curing Step and Curing Unit

In the method for manufacturing a removable information sheet according to the present embodiment, an applying step of applying an energy ray-curable pressure-sensitive composition precursor onto the recording medium with the toner image formed to form an energy ray-curable pressure-sensitive composition precursor layer, and a curing step of irradiating, with energy rays, the recording medium with the energy ray-curable pressure-sensitive composition precursor layer formed to cure the energy ray-curable pressure-sensitive composition precursor layer and then form an energy ray-curable pressure-sensitive composition are performed after the toner image forming step. In the case of describing the applying step and the curing step together, the steps may be referred to as an applying and curing step, and in the case of describing an applying unit and a curing unit together, the units may be referred to as an applying and curing unit.

In the present embodiment, the energy ray-curable pressure-sensitive composition precursor refers to a state before applying the precursor and from the application to curing the precursor, and the energy ray-curable pressure-sensitive composition precursor layer refers to a layer, a film, or the like formed from the energy ray-curable pressure-sensitive composition precursor. The energy ray-curable pressure-sensitive composition refers to the energy ray-curable pressure-sensitive composition precursor or energy ray-curable pressure-sensitive composition precursor layer irradiated with energy rays, and the precursor or layer irradiated with energy rays and then cured.

Examples of the energy rays include ultraviolet rays, and the energy ray-curable pressure-sensitive composition precursor may be thus referred to as an ultraviolet-curable pressure-sensitive composition precursor, an ultraviolet-curing pressure-sensitive composition precursor, an ultraviolet-curable varnish composition precursor, or the like. Similarly, the energy ray-curable pressure-sensitive composition may be referred to as an ultraviolet-curable pressure-sensitive composition, an ultraviolet-curing pressure-sensitive composition, an ultraviolet-curable varnish composition, or the like.

The ultraviolet-curable pressure-sensitive composition is laminated by applying the ultraviolet-curable pressure-sensitive composition precursor onto the recording medium bearing a toner image at any appropriate time after the fixing step described above, and curing the precursor. For example, the ultraviolet-curable composition can be cured by applying the ultraviolet-curable pressure-sensitive composition precursor after immediately forming a toner image, as in an in-line coating apparatus in which printing and overcoating are performed in the same printing device. In addition, as in an off-line coating apparatus in which printing and overcoating are performed in different printing devices, the precursor can be applied onto the recording medium bearing the toner image after a short or long delay time after printing. Furthermore, the ultraviolet-curable pressure-sensitive composition can be applied over the entire recording medium, the entire toner image, a part of the recording medium, or a part of the toner image. Depending on the intended application, the printing surface can be provided with protection or gloss.

For the bending described later, the ultraviolet-curable pressure-sensitive composition precursor is preferably not applied to the bent part for reducing the load on the bent part.

For applying the ultraviolet-curable pressure-sensitive composition precursor, liquid film coating devices can be used which include, for example, roll coaters, flexo coaters, rod coaters, blades, wire bars, air knives, curtain coaters, slide coaters, doctor knives, screen coaters, gravure coaters (e.g. offset gravure coaters), slot coaters, extrusion coaters, and ink jet coaters. Such devices can be used in well-known manners, such as, for example, by forward and reverse roll coating, offset gravure, curtain coating, lithographic coating, screen coating, gravure coating, and inkjet coating.

The coating thickness of the ultraviolet-curable pressure-sensitive composition precursor, that is, the thickness of the energy ray-curable pressure-sensitive composition precursor layer is not particularly limited, and can be appropriately selected in accordance with the intended use, but is preferably 1 μm to 15 μm. When the coating thickness is less than 1 μm, cissing may be cause, or gloss may be insufficient. When the coating thickness exceeds 15 μm, the texture of an image may be degraded.

After the ultraviolet-curable pressure-sensitive composition precursor is applied, the ultraviolet-curable pressure-sensitive composition precursor is subjected to curing. The ultraviolet-curable pressure-sensitive composition precursor can be subjected to curing by irradiation with light (mainly ultraviolet rays) from a light source.

The light source is not particularly limited, and can be appropriately selected in accordance with the intended use. Examples thereof include a low-pressure mercury lamp, a medium-pressure mercury lamp, a high-pressure mercury lamp, an ultra-high pressure mercury lamp, a xenon lamp, a carbon arc lamp, a metal halide lamp, a fluorescent lamp, a tungsten lamp, an argon ion laser, a helium-cadmium laser, a helium-neon laser, a krypton ion laser, various semiconductor lasers, a YAG laser, a light-emitting diode, a CRT light source, a plasma light source, an electron beam, a γ ray, an ArF excimer laser, a KrF excimer laser, and an F2 laser.

Figure 6:
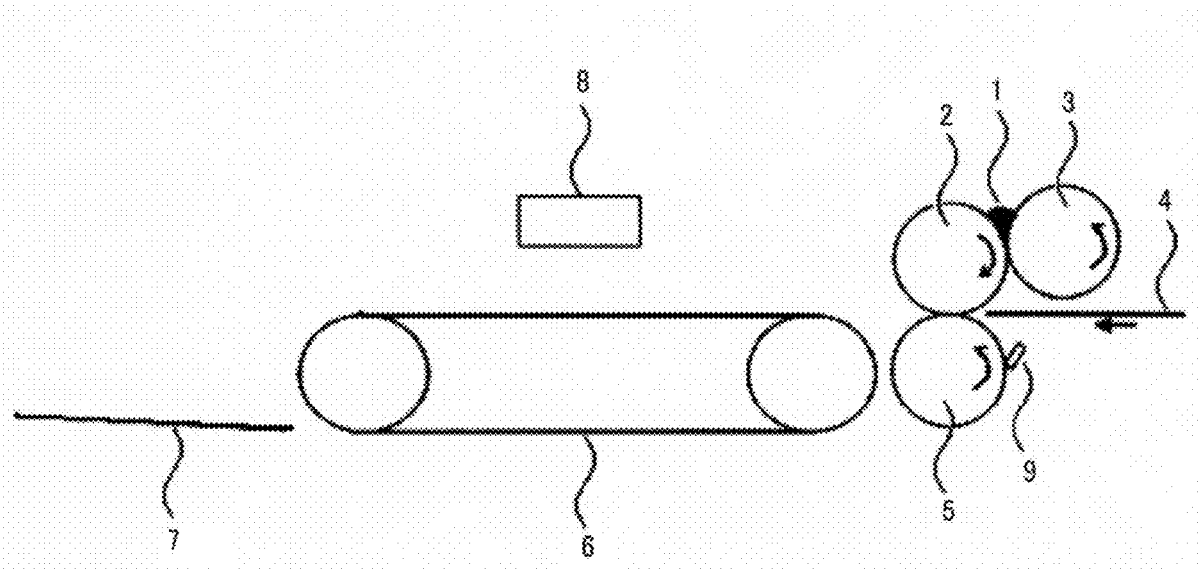
FIG. 6 is a diagram illustrating an example of a device for applying and curing an energy ray-curable pressure-sensitive composition precursor.

FIG. 6 illustrates an example of the coating unit. The applicator in FIG. 6 includes an application roller 2, a metal roller 3, a press roller 5, a conveying belt 6, a tray 7, a light source 8, and a scraper 9. An ultraviolet curable composition 1 is stored between the application roller 2 and the metal roller 3.

A recording medium 4 with a toner image formed passes between the application roller 2 and the press roller 5, with the recording medium 4 in contact with the rotating application roller 2 and press roller 5. In such a case, the ultraviolet-curable pressure-sensitive composition precursor 1 on the surface of the application roller 2 is transferred to the recording medium 4, and thus, the ultraviolet-curable pressure-sensitive composition precursor 1 is applied to the recording medium 4.

The recording medium 4 with the ultraviolet-curable pressure-sensitive composition precursor 1 applied thereto is conveyed by the conveying belt 6 to pass under the light source 8. In such a case, the ultraviolet-curable pressure-sensitive composition precursor 1 applied to the recording medium 4 is cured by ultraviolet rays from the light source 8. Thereafter, the recording medium 4 moves onto the tray 7. The unnecessary ultraviolet-curable pressure-sensitive composition precursor 1 adhering to the press roller 5 is removed by the scraper 9. The step of applying and curing the ultraviolet-curable pressure-sensitive composition precursor and the unit for applying and curing the ultraviolet-curable pressure-sensitive composition precursor are also the same as those of the ultraviolet-curable composition.

—Ultraviolet-Curable Pressure-Sensitive Composition Precursor—

Examples of the components included in the ultraviolet-curable pressure-sensitive composition precursor for use in the present invention include a polymerizable oligomer, a polymerizable unsaturated compound, a photopolymerization initiator, a sensitizer, a polymerization inhibitor, and a surfactant.

Polymerizable Oligomer

The polymerizable oligomer is not particularly limited, and can be appropriately selected in accordance with the intended use. Examples thereof include a polyester acrylate, an epoxy acrylate, and a urethane acrylate.

The polyester acrylate is not particularly limited, and can be appropriately selected in accordance with the intended use. Examples thereof include acrylic acid esters of polyester polyols obtained from polyhydric alcohols and polybasic acids. The polyester acrylate exhibits excellent reactivity.

The epoxy acrylate is not particularly limited, and can be appropriately selected in accordance with the intended use. Examples thereof include epoxy acrylates obtained by the reaction of a bisphenol-type epoxy, a novolac-type epoxy, an alicyclic epoxy, or the like with an acrylic acid. The epoxy acrylate is excellent in hardness, flexibility, and curability.

The urethane acrylate is not particularly limited, and can be appropriately selected in accordance with the intended use. Examples thereof include a urethane acrylate obtained by reacting a polyester polyol, a polyether polyol, or the like with a diisocyanate and an acrylic acid ester having a hydroxyl group. The use of the urethane acrylate provides a flexible and tough film.

The polymerizable oligomers may be used alone, or two or more thereof may be used in combination.

The content of the polymerizable oligomer in the ultraviolet-curable pressure-sensitive composition precursor is not particularly limited, and can be appropriately selected in accordance with the intended use. For example, the content is preferably 5% by mass to 60% by mass, more preferably 10% by mass to 50% by mass, particularly preferably 20% by mass to 45% by mass with respect to the composition. When the content is less than 5% by mass, defective curing may be caused, the viscosity may be excessively low, or the flexibility after curing may be impaired. When the content exceeds 60% by mass, the adhesion may be decreased, or the viscosity may be excessively high. The content within the particularly preferred range is advantageous in terms of optimization of viscosity, curability, and flexibility and strength of coating layer of the ultraviolet-curable composition cured.

Polymerizable Unsaturated Compound

The polymerizable unsaturated compound is not particularly limited, and can be appropriately selected in accordance with the intended use. Examples thereof include monofunctional polymerizable unsaturated compounds, bifunctional polymerizable unsaturated compounds, trifunctional polymerizable unsaturated compounds, and tetrafunctional or higher polymerizable unsaturated compounds.

Examples of the monofunctional polymerizable unsaturated compounds include 2-ethylhexyl acrylate, 2-hydroxyethyl acrylate, 2-hydroxyethyl acrylate, 2-hydroxypropyl acrylate, benzyl acrylate, phenyl glycol monoacrylate, and cyclohexyl acrylate.

Examples of the bifunctional polymerizable unsaturated compounds include 1,4-butanediol diacrylate, 1,6-hexanediol diacrylate, 1,9-nonanediol diacrylate, tripropylene glycol diacrylate, and tetraethylene glycol diacrylate.

Examples of the trifunctional polymerizable unsaturated compounds include trimethylolpropane triacrylate, pentaerythritol triacrylate, and tris(2-hydroxyethyl) isocyanurate triacrylate.

Examples of the tetrafunctional or higher polymerizable unsaturated compounds include pentaerythritol tetraacrylate, ditrimethylolpropane tetraacrylate, dipentaerythritol hydroxypentaacrylate, and dipentaerythritol hexaacrylate.

Examples of the material with high melting ability include 1,6-hexanediol diacrylate, ethyl carbitol acrylate, and acryloyl morpholine. Because the melting ability varies depending on each material, the added amount is required to be tuned for each material. If the amount is excessively small, however, defective adhesion may be caused. If the amount is excessively large, image disturbance may be caused.

The polymerizable unsaturated compounds may be used alone, or two or more thereof may be used in combination.

The content of the polymerizable unsaturated compound in the ultraviolet-curable pressure-sensitive composition precursor is not particularly limited, and can be appropriately selected in accordance with the intended use. For example, the content is preferably 35% by mass to 90% by mass, more preferably 40% by mass to 85% by mass, particularly preferably 45% by mass to 75% by mass. When the content is less than 35% by mass, the viscosity may be excessively increased. When the content exceeds 90% by mass, defective curing may be caused, the viscosity may be excessively low, or the flexibility after curing may be impaired. The content within the particularly preferred range is advantageous in terms of optimization of viscosity, curability, and coating layer of the ultraviolet-curable pressure-sensitive composition cured.

The polyfunctional polymerizable unsaturated compounds are higher in curing rate than the monofunctional polymerizable unsaturated compounds, and suitable for high-speed fixing but large in volume shrinkage. In the case of a polymerizable unsaturated compound that is greatly shrunk by a curing reaction, curls are more likely to generated, and thus, it is desirable to use a polymerizable unsaturated compound that is low in volume shrinkage ratio as much as possible and a polymer thereof.

The polymerizable unsaturated compound preferably has a volume shrinkage ratio of 15% or less.

The P.I.I. (skin irritation) of the polymerizable unsaturated compound and polymerizable oligomer is not particularly limited, and can be appropriately selected in accordance with the intended use, but is preferably 1.0 or less. When the P.I.I. exceeds 1.0, the stimulation to skin may be excessively strong, thereby resulting in a disadvantage in safety.

In addition, the hues of the polymerizable unsaturated compound and of the polymerizable oligomer are preferably as close to colorless and transparent as possible, and preferably 2 or less on the Gardner gray scale. When the Gardner gray scale exceeds 2, the color of the image part may be changed, and the discoloration of the background part may be conspicuous.

Photopolymerization Initiator

The photopolymerization initiator is not particularly limited, and can be appropriately selected in accordance with the intended use. Examples thereof include benzophenone, benzoin ethyl ether, benzoin isopropyl ether, and benzyl.

As the photopolymerization initiator, commercially available products can be used. Examples of the commercially available photopolymerization initiators include IRGACURE 1300, IRGACURE 369, and IRGACURE 907 from Ciba Specialty Chemicals Inc.; and Lucirin TPO from BASF.

When a mixture of the polymerizable oligomer or the polymerizable unsaturated compound with the photopolymerization initiator is irradiated with ultraviolet rays, the photopolymerization initiator generates radicals as illustrated in the following formulas (I) and (II). The radicals cause an addition reaction for the polymerizable double bonds of the polymerizable oligomer or of the polymerizable unsaturated compound. The addition reaction further generates radicals to repeat the addition reaction for the polymerizable double bonds of the other polymerizable oligomer or polymerizable unsaturated compound, thereby causing a polymerization reaction to proceed as in the following formula (III).

(I) Hydrogen abstraction type

[Chemical Formula 1]

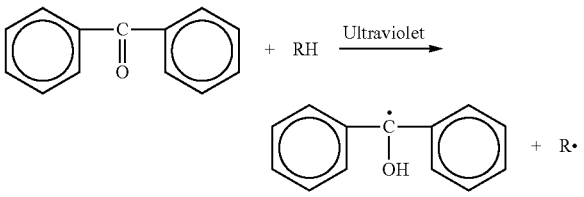

(II) Photofragmentation type

[Chemical Formula 2]

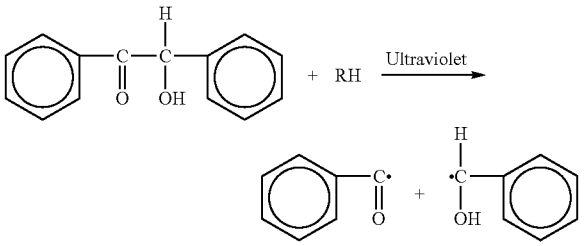

(III) Polymerization

[Chemical Formula 3]

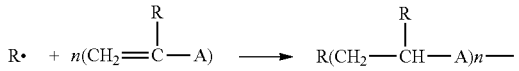

Preferred as the photopolymerization initiator are photopolymerization initiators that have favorable properties such as (i) high ultraviolet absorption efficiency, (ii) high solubility in the polymerizable oligomer or the polymerizable unsaturated compound, (iii) little odor, yellowing, and toxicity, and (iv) no dark reaction caused.

The content of the photopolymerization initiator in the ultraviolet-curable pressure-sensitive composition precursor is not particularly limited, and can be appropriately selected in accordance with the intended use. For example, the content is preferably 1% by mass to 10% by mass, more preferably 2% by mass to 5% by mass.

Sensitizer

In the case of using the hydrogen abstraction-type benzophenone-based photopolymerization initiator of the formula (I), the reaction may be delayed only with the photopolymerization initiator, and thus, it is preferable to enhance the reactivity by, for example, the use of an amine-based sensitizer in combination. Containing the amine-based sensitizer has the effect of supplying hydrogen to the photopolymerization initiator by the action of hydrogen abstraction, and the effect of preventing the reaction inhibition caused by oxygen in the air.

The amine-based sensitizer is not particularly limited, and can be appropriately selected in accordance with the intended use. Examples thereof include triethanolamine, triisopropanolamine, 4,4-diethylaminobenzophenone, 2-dimethylaminoethylbenzoic acid, ethyl 4-dimethylaminobenzoate, and isoacyl 4-dimethylaminobenzoate.

The content of the sensitizer in the ultraviolet-curable pressure-sensitive composition precursor is not particularly limited, and can be appropriately selected in accordance with the intended use. For example, the content is preferably 1% by mass to 15% by mass, more preferably 3% by mass to 8% by mass.

Polymerization Inhibitor

The polymerization inhibitor is used for enhancing storage stability of the ultraviolet-curable pressure-sensitive composition precursor. The polymerization inhibitor is not particularly limited, and can be appropriately selected in accordance with the intended use. Examples thereof include 2,6-di tert-butyl-p-cresol (BHT), 2,3-dimethyl-6-tert-butylphenol (IA), anthraquinone, hydroquinone (HQ), and hydroquinone monomethyl ether (MEHQ).

The content of the polymerization inhibitor in the ultraviolet-curable pressure-sensitive composition precursor is not particularly limited, and can be appropriately selected in accordance with the intended use. For example, the content is preferably 0.5 to 3% by mass.

Surfactant

The surfactant is contained in the ultraviolet-curable pressure-sensitive composition precursor, thereby providing adsorbability to the interface between the toner and the ultraviolet-curable pressure-sensitive composition precursor, or reducing the surface tension of the ultraviolet-curable pressure-sensitive composition precursor to improve the wettability.

The surfactant is not particularly limited, and can be appropriately selected in accordance with the intended use. Examples thereof include anionic surfactants, nonionic surfactants, silicon surfactants, and fluorosurfactants.

Examples of the anionic surfactants include sulfosuccinates, disulfonates, phosphates, sulfates, sulfonates, and mixtures thereof. Examples of the nonionic surfactants include polyvinyl alcohols, polyacrylic acids, isopropyl alcohols, acetylene-based diols, ethoxylated octylphenols, ethoxylated branched secondary alcohols, perfluorobutanesulfonates, and alkoxylated alcohols. Examples of the silicon surfactants include polyether-modified polydimethylosiloxanes. Examples of the fluorosurfactants include ethoxylated nonylphenols.

The content of the surfactant in the ultraviolet-curable pressure-sensitive composition precursor is not particularly limited, and can be appropriately selected in accordance with the intended use. For example, the content is preferably 0.1% by mass to 5% by mass, more preferably 0.5% by mass to 3% by mass. When the content is less than 0.1% by mass, wettability may fail to be obtained. When the content exceeds 5 mass %, curability may be inhibited. The content within the more preferred range is advantageous in terms of improvement in wettability.

Examples of the other components further include leveling agents, matting agents, waxes for adjusting film properties, and tackifiers for improving adhesion to a recording medium such as a polyolefin or a poly ethylene terephthalate (PET), without inhibiting polymerization.

In addition, it is preferable to contain a polymer that is compatible with the polymerizable oligomer or the polymerizable unsaturated compound. The presence of this polymer can ensure pressure bonding, without destroying or moving the energy ray-curable pressure-sensitive composition precursor layer against pressure bonding in the production of a protective agent sheet. As a preferred polymer, a (meth)acrylic copolymer that has a weight average molecular weight of 10,000 to 100,000 and a glass transition temperature of −60° C. to 20° C. is most preferred, because the copolymer is highly compatible with the polymerizable oligomer and the polymerizable unsaturated compound, excellent in pressure-bonding, and excellent in removability.

The (meth)acrylic copolymer in the present invention is obtained by polymerizing a monomer component including an acrylic acid alkyl ester or a methacrylic acid alkyl ester with an organic solvent as a polymerization solvent.

Examples of the acrylic acid alkyl ester or methacrylic acid alkyl ester include methyl (meth)acrylates, ethyl (meth) acrylates, n-butyl (meth)acrylates, i-butyl (meth)acrylates, t-butyl (meth)acrylates, 2-ethylhexyl (meth)acrylates, lauryl (meth)acrylates, stearyl (meth)acrylates, cyclohexyl (meth) acrylates, n-decyl (meth)acrylates, and glycol di(meth)acrylates, for example, ethylene glycol di(meth)acrylates, butylene glycol di(meth)acrylates, and 1,6-hexanediol di(meth) acrylates.

In the production of the (meth)acrylic copolymer, ethylenically unsaturated monomers that are copolymerizable with the (meth)acrylic acid ester, for example, ethylenically unsaturated monomers containing a carboxylic acid such as an acrylic acid, a methacrylic acid, or an itaconic acid, and ethylenically unsaturated monomers having a functional group, such as hydroxyalkyl (meth)acrylates, for example, 2-hydroxymethyl (meth)acrylates, 2-hydroxyethyl (meth) acrylates, and 2-hydroxypropyl (meth)acrylates, and alkylamino (meth)acrylates, for example, dimethylaminoethyl (meth)acrylates and diethylaminoethyl (meth)acrylates, and methoxyethyl (meth)acrylates and ethoxyethyl (meth)acrylates, and glycidyl (meth)acrylates, (meth)acrylonitriles, and (meth)acrylamides, vinyl acetates, vinyl propionates, styrene, α-methylstyrene, and the like can be subjected to copolymerization, as necessary.

As the polymerization solvent for the (meth)acrylic copolymer, each organic solvent can be used, and examples thereof include alcohols such as a methyl alcohol, an ethyl alcohol, an n-propyl alcohol, an i-propyl alcohol, an n-butyl alcohol, and an i-butyl alcohol, cellosolves such as a cellosolve acetate, a methyl cellosolve, an ethyl cellosolve, an n-butyl cellosolve, an i-butyl cellosolve, and an n-propyl cellosolve, propylene glycol ethers such as a propylene glycol-n-butyl ether, a propylene glycol methyl ether, a propylene glycol phenyl ether, a dipropylene glycol methyl ether, and a propylene glycol methyl ether acetate, toluene, ethyl acetates, butyl acetates, acetone, methyl ethyl ketones, aromatic (petroleum fraction) solvents, phthalic acid ester-based plasticizers, and alkyl phosphoric acid esters.

In the preparation of the ultraviolet-curable pressure-sensitive composition precursor, the (meth)acrylic copolymer (B) solution dissolved in the solvent may be blended as it is, and in that case, the solvent may be finally removed from the composition.

The (meth)acrylic copolymer synthesized as described above can find particularly effective use in a specific molecular weight range and a specific glass transition temperature range.

The weight average molecular weight of the (meth)acrylic copolymer needs to be 10,000 to 100,000, and is preferably 20,000 to 50,000. When this component is less than 10,000 in weight average molecular weight, the cohesive force will be insufficient, the adhesiveness will be low, and moderate removability and adhesiveness may fail to be obtained.

In addition, when this component exceeds 100,000 in weight average molecular weight, the compatibility with the polymerizable oligomer and the polymerizable unsaturated compound may be degraded. In such a case, it is necessary to use a large amount of diluent for blending the component into the polymerizable oligomer or the polymerizable unsaturated compound, which leads to a decrease in curing speed and a decrease in surface gloss due to ultraviolet rays, and results in bigger disadvantages in hygiene and in the Fire Service Act due to the working environment degraded with the solvent.

Next, the glass transition temperature of the (meth)acrylic copolymer needs to fall within the range of −60 to 20° C., preferably −50 to 10° C. When this component has a glass transition temperature of lower than −60° C., because of the strong sticky feeling, the adhesive strength may be insufficiently obtained. When this component (B) has a glass transition temperature of higher than 20° C., removability or adhesiveness may fail to be obtained.

The glass transition temperature referred to in the present disclosure refers to a secondary transition point measured for a common polymer as described in, for example, "Acrylic Acid Ester and Polymer thereof (II)" written by Eizou Ohmori, published by SHOKODO Co., Ltd., pages 110 to 115. In the case of a copolymer, the glass transition temperature refers to the calculated glass transition temperature described on page 120 of the foregoing document.

The (meth)acrylic copolymer described above has favorable compatibility with the polymerizable oligomer and the polymerizable unsaturated compound, thus allowing for an ultraviolet-curable varnish composition in which the component (B) is uniformly dissolved.

The blending proportion of the (meth)acrylic copolymer to the polymerizable oligomer and the polymerizable unsaturated compound is not to be considered particularly limited. The preferred range is 5 to 80 parts by weight with respect to 100 parts by weight in total of the polymerizable oligomer and the polymerizable unsaturated compound. When the blending proportion is less than 5 parts by weight, the varnish composition may fail to provide sufficient removability or adhesiveness or may have adhesiveness weakened. When the proportion exceeds 80 parts by weight, the obtained varnish composition has a strong sticky feeling, and the glossiness of the original varnish is also decreased. Thus, excessively strong adhesiveness for removal may possibly tear the paper, and also result in insufficient blocking resistance for the coated paper.

It is to be noted that the blending proportion (parts by weight) of this component refers to the amount of only the copolymer component, excluding the solvent and the like used for polymerization.

In the present invention, the (meth)acrylic copolymer is uniformly compatible with other components in the composition to reach a solution state, and the coating surface will thus have excellent gloss produced, and blocking resistance provided in atmospheres under normal living environments.

Pressure-bonding Step and Pressure-bonding Unit and Fending Step and Folding

Unit

The method for manufacturing a removable information sheet according to the present invention includes a pressure-bonding step of attaching the cured surfaces of the energy ray-curable pressure-sensitive composition precursor layer to each other and pressure-bonding the surfaces by a pressure-bonding unit. The pressure-bonding step is performed by the pressure-bonding unit. In addition, a folding step may be performed before the pressure-bonding step.

The physical conditions for the attachment can be appropriately selected. The surfaces of the varnish composition applied to the paper surface and cured can be attached to each other, and with the use of, for example, pressurization at a linear pressure of approximately 10 to 50 kg/cm or a linear pressure of approximately 0.1 to 10 kg/cm in combination with heating at a temperature of 50 to 150° C. In these cases, the component leaches onto the surfaces to form an adhesive layer on the varnish coating layer surfaces, allowing the varnish composition surfaces to be removably bonded to each other.

The adhesive strength can be appropriately adjusted by selecting the physical conditions and changing each of the blending proportion, glass transition temperature, and average molecular weight of the component, and is weaker than the adhesive strength between the printing surface and the varnish surface, and capable of providing moderate removability without damaging the surface during removal.

The viscosity of the ultraviolet-curable pressure-sensitive composition precursor is not particularly limited, and can be appropriately selected in accordance with the intended use, but the viscosity at 25° C. is preferably 10 mPa·s to 800 mPa·s. The viscosity of less than 10 mPa·s or more than 800 mPa·s, may make or difficult to control the coating thickness.

The viscosity can be measured by, for example, a B-type viscometer (from Toyo Seiki Seisaku-sho, Ltd.).

The ultraviolet-curable pressure-sensitive composition precursor can also be prepared as an oil-based type with the use of a solvent, but the case of an ultraviolet-curable (photocurable) type with the use of UV is preferred from the viewpoints of ensuring safety, environmental protection, energy saving, and high productivity.

In the folding step, the recording medium with the ultraviolet-curable pressure-sensitive composition precursor cured is subjected to, for example, twofold (V-fold), threefold (Z-fold), or the like, and the surfaces treated with the ultraviolet-curable pressure-sensitive composition are aligned with each other. After the alignment is performed in this manner, the pressure-bonding is performed by the pressure-bonding unit.

When the ultraviolet-curable pressure-sensitive composition is used, after the applying and curing step, a folding step of cutting the composition into a desired size as necessary and, for example, folding the composition in two or three is performed, and the surfaces processed with the ultraviolet curable pressure-sensitive composition are combined. The surfaces treated with the ultraviolet-curable pressure-sensitive composition are attached to each other by roller pressure bonding to obtain an adhesive product with removability. The pressurization amount for the pressure bonding typically falls within the range of 50 to 1000 N/cm$^2$.

One sheet is bent and pressure-bonded in this manner, thereby enhancing the productivity. It is to be noted that the ultraviolet-curable pressure-sensitive composition is preferably not applied to the bent part because the bent part is not damaged in removal. The pressure-bonding step and the folding step may be each independently performed multiple times.

Heating and Pressurizing Step and Heating and Pressurizing Unit

In the method for manufacturing a removable information sheet according to the present invention, providing a heating and pressurizing step can perfectly prevent the toner image from being broken. The heating and pressurizing step is performed in a downstream step from the step of applying and curing the energy ray-curable pressure-sensitive composition precursor. In addition, the heating and pressurizing step is performed after the folding step or the pressure-bonding step.

In performing after the folding step, the pressure-bonding step can also serve as the heating and pressurizing step. In this case, the pressure-bonding unit performs pressure-bonding while heating the recording medium.

The heating and pressurizing step is a step of pressure-bonding, on heating, the laminate to be subjected to pressure bonding on heating, and the heating and the pressure-bonding are preferably performed simultaneously in terms of productivity. The present invention is, however, not limited thereto, and for making the temperature of the laminate uniform, the laminate may be subjected to pressure bonding on heating after only heating or pressure bonding on heating with a weak force. The heating and pressurizing step may be performed not only once but also multiple times. In the case of performing the heating and pressurizing step after the pressure-bonding step, the heating and pressurizing step can be performed in same manner as the pressure bonding step mentioned above.

In addition, the fixing step and the fixing unit may be used for the heating and pressurizing step and the heating and pressurizing unit. For example, after the fixing step, the fixing step is repeated again in such a form as substitution for white paper printing (however, without passing through any developing step or the like, such a phenomenon as fixing any toner or the like is thus not caused), thereby allowing the heating and pressurization to be performed with the use of the same fixing unit. Alternatively, the heating and pressurizing step may be replaced with a fixing step in such an image forming process as address writing instead of the white paper printing.

In addition, the function of the heating and pressurizing unit may be added to the pressure bonding step and the pressure bonding unit. Because of the conveyance through the folding step, however, it is necessary to set the heating temperature and the pressurizing force with more margin than in the fixing step and the fixing unit. In addition, in the case of adding the function of the heating and pressurizing unit to the pressure bonding step and the pressure bonding unit, the setting of balance with the heating temperature is required because the pressurization is typically considerably higher than in the fixing step and the fixing unit.

When the heating and pressurizing step is simultaneously performed in the pressure bonding step, the productivity is remarkably improved, but because of the very high pressure for the pressure bonding step, the volume expansion of the pressure-bonding roller in the pressure bonding device during the heating may result in a disadvantage, thereby making device maintenance likely to be complicated. In the case of performing the heating and pressurizing step after the pressure bonding step, the device is smaller in size, lower in cost, and also higher in durability, because the pressure is lower than that in the pressure bonding step.

In the heating and pressurizing step, pressure bonding is performed while applying a temperature equal to or higher than the softening temperature of the toner. Thus, the enhanced strength between the toner image layer and the loading material of the paper and the enhanced strength of the coat layer allow removal in a favorable manner, which is preferred.

Relationship Between Wax and Present Invention

The adhesiveness between the toner image and the ultraviolet-curable pressure-sensitive composition depends on the condition of the wax at the toner image surface, and the adhesiveness between the toner image and the ultraviolet-curable pressure-sensitive composition is believed to degrade as the wax at the toner image surface has a coverage increased. Japanese Patent No. 6163943 specifies the coverage of a wax at the surface of a toner image with favorable image quality and adhesiveness between the toner image and an ultraviolet-curable pressure-sensitive composition.

When the pressure-bonded postcards prepared with the toner image with the wax coverage specified in Japanese Patent No. 6163943 are stored in a high-humidity environment, however, the adhesive strength between the surface of the toner image and the ultraviolet-curable pressure-sensitive composition may be decreased, although the toner image is not broken. In this case, when the pressure-bonded postcard is peeled off, disadvantageously, the ultraviolet-curable pressure-sensitive composition at the surface of the toner image partially adheres to the ultraviolet-curable pressure-sensitive composition at the surface of the toner image on the other side bonded.

The present inventors have focused on oil-less fixing, and have conducted detailed investigation on the repelling phenomenon of an energy ray-curable pressure-sensitive composition precursor on a toner image subjected to oil-less fixing. As a result, it has been found that the sites easily repelled by the energy ray-curable pressure-sensitive composition precursor are not uniformly present, but the precursor easily repels at a solid part that has a toner image and a large toner image area. Then, observing a cross section of the solid part of the toner image subjected to the oil-less fixing with an electron microscope has found that the wax in the toner covers most of the toner image surface.

Furthermore, it has been found that in the case where the energy ray-curable pressure-sensitive composition precursor layer is provided on the toner image subjected to the oil-less fixing, sites where the energy ray-curable pressure-sensitive composition precursor layer is easily peeled are sites where the toner image is present, and in particular, solid parts (in particular, red, blue, and green sites) having a large toner adhesion amount are most easily peeled. It is to be noted that the oil-less fixing herein means that fixing is performed without using any lubricant or lubricating oil in the fixing step of the toner image forming process.

Then, the present inventors observed, with an electron microscope, the interface between a solid part of the toner image subjected to the oil-less fixing, provided with the energy ray-curable pressure-sensitive composition, and the energy ray-curable pressure-sensitive composition. Then, the present inventors have found that there is a site with the wax present at the interface between the solid part and the energy ray-curable pressure-sensitive composition, and that there is a site where the energy ray-curable pressure-sensitive composition is slightly lifted at the site with the wax present. More specifically, the inventors have found that the adhesion between the energy ray-curable pressure-sensitive composition and the oil-less fixed image is decreased with the increased number of sites contact between the wax and the energy ray-curable pressure-sensitive composition precursor.

From these findings, the presence of the wax over a large area on the toner image subjected to the oil-less fixing is believed to inhibit the adhesion with the energy ray-curable pressure-sensitive composition. In addition, the inventors have found that the energy ray-curable pressure-sensitive composition with high durability fails to be provided unless the toner image is an oil-less fixed toner image with less wax on the toner image surface.

The present inventors have further exhaustively considered from another viewpoint. More specifically, the wax related to the adhesion between the energy ray-curable pressure-sensitive composition and the oil-less fixed image is distributed on the outermost surface of the oil-less fixed image, and the wax present inside the image is not related thereto. For this reason, whether an oil-less fixed image on which the energy ray-curable pressure-sensitive composition can be suitably provided can be defined or not has been considered from the distribution state of the wax on the outermost surface of the oil-less fixed image.

In this regard, as an approach for observing a structure in a polymer, a section of the polymer is treated with an osmium tetroxide (K. Kato: Polym. Eng. Sci., 7, 38), a ruthenium tetroxide (J. S Trent et al.: Macromolecules, 16, 589), a phosphotungstic acid (K. Hess et al.: Kalloid-Z, 168, 37), or the like in transmission electron microscope (TEM) observation.

This approach is typically implemented as a method for providing a contrast to a TEM image, because how to be chemically modified differs depending on each polymer, and because the substance for the chemical modification has a heavy metal, thus making electron transmission harder, with the result that a chemically modified polymer is observed darkly, whereas a polymer not chemically modified is observed brightly. Among these substances, the ruthenium tetroxide is preferred in that the ruthenium tetroxide can be applied to many polymer materials.

The toner matrix particles including a binder resin such as polyester or polystyrene are more likely to be chemically modified with the ruthenium tetroxide, and the wax is considerably less likely to be chemically modified with the ruthenium tetroxide than the toner matrix particles. The inventors have focused on the foregoing to consider whether a location with the wax and a location without wax the wax can be distinguished or not in a scanning electron microscope image (SEM image) if the oil-less fixed image is chemically modified with the ruthenium tetroxide. More specifically, Ru, which is a constituent element of the ruthenium tetroxide, has a much larger atomic number than hydrogen, carbon, nitrogen, and oxygen, which are constituent elements of the oil-less fixed image, thus allowing the utilization of the characteristic fact that the quantity of reflected electrons or secondary electrons from the sample is larger for an element that has a larger atomic number in the SEM image.

In addition, the ruthenium tetroxide modifies only the outermost surface of the sample, and there is thus a need for the depth region observed with a scanning electron microscope (SEM) to be close to the outermost surface as much as possible. In general, in SEM observation, the depth to be observed is known to depend on the acceleration voltage, and with the acceleration voltage is 1 kV or lower, only information at a depth of several tens nm or less can be observed.

Based on the foregoing, the inventors have found that when the fixed image surface is observed with reflected electrons at an acceleration voltage of 0.8 kV in a SEM after treating the oil-less fixed image with a ruthenium tetroxide vapor, a part with the wax is observed darkly, whereas a part without the wax is observed brightly.

Furthermore, the inventors have found that the proportion of the area of the dark part of the SEM image (reflected electron image) can be treated as the coverage of the wax at the outermost surface of the oil-less fixed image, and that the coverage of the wax at the outermost surface of the oil-less fixed image can be used to define an oil-less fixed image on which an energy ray-curable pressure-sensitive adhesive can be suitably provided.

The coverage of the wax is determined as follows. With the use of the test chart No. 7 2008 of the Imaging Society of Japan, a fixed solid image of at least one of red, green, and blue is exposed to a saturated vapor of an aqueous ruthenium tetroxide solution, and then irradiated with electron beams at an acceleration voltage of 0.8 kV with the use of an SEM, and the reflected electron image obtained is converted into a binarized image including a black part and a white part. The proportion of the area of the black part to the area of the entire binarized image is referred to as a wax coverage.

In the present invention, the coverage of the wax is preferably 40% to 70%, more preferably 42% to 65%. When the coverage of the wax is 40% or more, the releasability between the fixing roller and the image is kept from being degraded, thereby providing a high-quality image. When the coverage is 70% or less, the adhesion of the energy ray-curable pressure-sensitive composition can be kept from being degraded. It is to be noted that, also in the case where a monochrome image is formed in an image forming apparatus that forms toner images, the coverage of the wax of the monochrome image is preferably 40% to 70%.

Chemical Modification Treatment

In the method for measuring the coverage of the wax, the concentration of the ruthenium tetroxide for exposing the surface of the oil-less fixed image to the saturated vapor of the aqueous ruthenium tetroxide solution may be any concentration as long as the chemical modification with the ruthenium tetroxide can be performed safely and reproducibly. For example, the use of a 5% by mass aqueous solution of ruthenium tetroxide (for example, from TABB (UK)), which is commercially available to the public as a reagent for electron microscopes is preferred because the chemical modification with the ruthenium tetroxide can be performed stably.

When the aqueous ruthenium tetroxide solution is placed in a sealed space, the ruthenium tetroxide volatilizes and turns into saturated vapor, and thus, the oil-less fixed image can be easily chemically modified with the ruthenium tetroxide by placing the oil-less fixed image in the sealed space. In this regard, the temperature for the exposure to the saturated vapor of the aqueous ruthenium tetroxide solution may be a normal room temperature, and is, for example, preferably 15° C. to 35° C., more preferably 18° C. to 30° C.

The time for exposing the saturated vapor of the aqueous ruthenium tetroxide solution is not particularly limited as long as the oil-less fixing image is reliably chemically modified, and can be clearly separated from the release agent in SEM observation, but is preferably 3 minutes to 8 minutes, more preferably 4 minutes to 6 minutes. When the exposure time is shorter than 3 minutes, the chemical modification of the oil-less fixed image may be insufficient, thereby making it difficult to clearly separate the release agent and the fixed image, which is not preferred. In contrast, when the exposure time exceeds 8 minutes, the ruthenium tetroxide adheres also to the surface of the release agent, and the proportion of the dark part observed in the SEM image may be increased, or the boundary may be unclear between the site with the release agent present and the site without the release agent present.

SEM Observation

When the surface of the oil-less fixed image treated with the ruthenium tetroxide is observed with a scanning electron microscope (SEM), the part with the wax present is observed darkly, whereas the part without the wax present is observed brightly. The acceleration voltage in this case is preferably 0.3 kV to 1.0 kV, more preferably 0.5 kV to 0.9 kV. When the acceleration voltage exceeds 1.0 kV, information from a deep site of the oil-less fixed image will be detected. Accordingly, when the wax adheres thinly, information on the surface of the oil-less fixed image chemically modified with the ruthenium tetroxide will be also picked up through the wax. In the present invention, the use of an acceleration voltage of 0.8 kV allows the existence region of the wax at the outermost surface to be observed with reproducibility.

When the oil-less fixed image treated with the ruthenium tetroxide is observed with a SEM, in both the secondary electron image and the reflected electron image, a site with the wax present is observed darkly, whereas a site without the wax present is observed brightly, and the reflected electron image can more clearly distinguish the site with the wax present and the site without the wax present. This is because both the reflected electrons and the secondary electrons are generated more as the element has a larger atomic number, but the dependence of the generation on the atomic number is higher in the case of the reflected electrons than that in the case of the secondary electrons. Accordingly, in the reflected electron image, a site with the wax present is darker, whereas a site without the wax present is brighter, such that the irregularity information of the oil-less fixed image can be excluded, which is preferred.

The magnification at which the reflected electron image is captured is appropriately selected depending on the existence of the wax, and may be any magnification as long as the region with the toner present is captured, but is preferably 100 times to 2,000 times.

The range of acquiring the reflected electron image may be a region of 250 μm×250 μm or more, and in the case of acquiring the reflected electron image in a smaller region, reflected electron images corresponding to the region of 250 μm×250 μm are acquired, and the wax coverage described later is calculated. In the case of using multiple reflected electron images, the average value for the wax coverages is used.

Binarization Processing

Figure 7A:
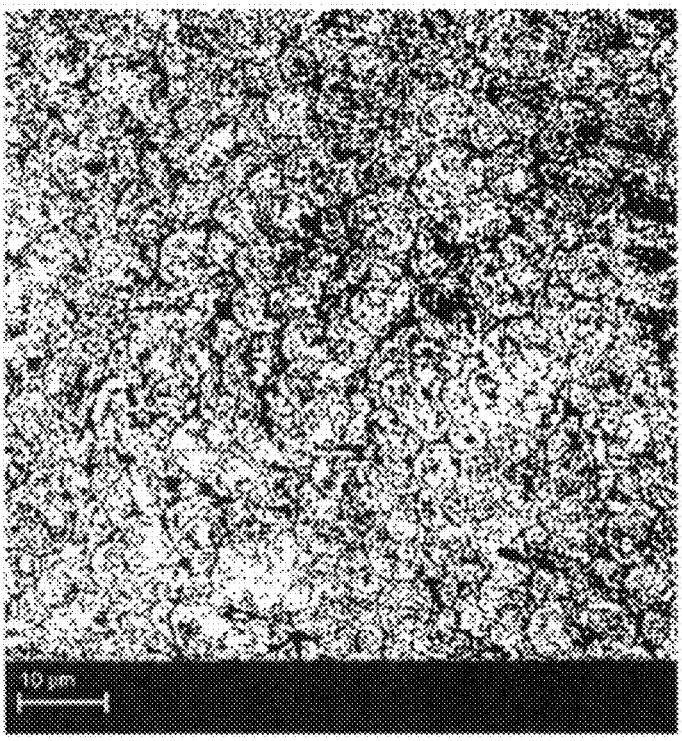
FIGS. 7A and 7B are images in the case of binarizing another example of an electron micrograph in a solid part of a toner image.
Figure 7B:
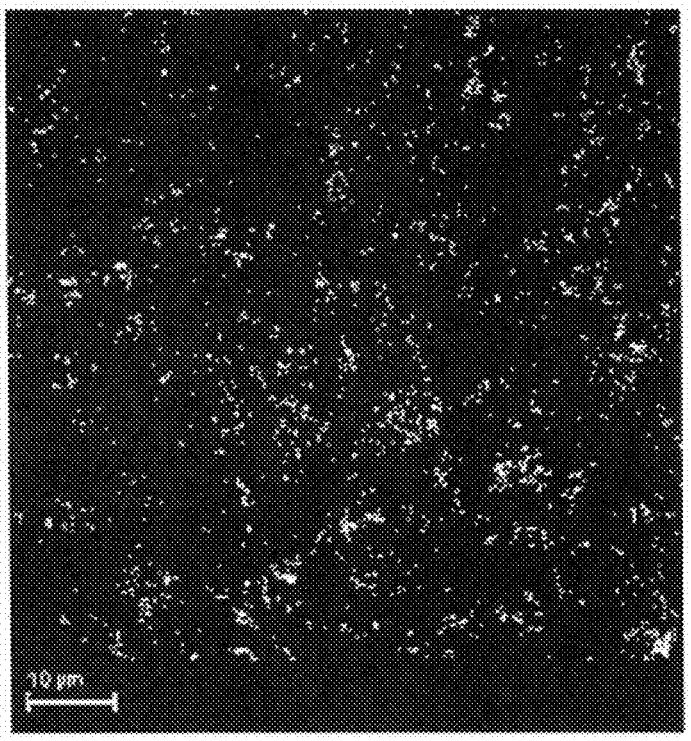

Image processing (binarization) of dividing each pixel (or a predetermined number of pixel units) constituting the obtained reflected electron image (image data) into either a part that looks white (black part) or a part that looks black (white part) is performed to obtain a binarized image. FIGS. 7A and 7B illustrate examples of binarized images obtained by binarizing reflected electron images. FIG. 7A illustrates a binarized image obtained by binarizing an oil-less fixed image that has poor adhesion to the energy ray-curable pressure-sensitive adhesive, and FIG. 7B illustrates a binarized image obtained by binarizing an oil-less fixed image that has favorable adhesion to the energy ray-curable pressure-sensitive adhesive.

In the binarization, for example, brightness may be determined for each pixel (pixel) such that the pixel is regarded as a white part if the brightness is equal to or more than a certain value (threshold value), or regarded as a black part if the brightness is less than the certain value. In addition, the threshold value is set with reference to the histogram of the brightness, the image before the binarization is a substantially binarized image, and thus without any problem in setting the threshold value, the binarized image is not greatly affected even if the threshold is slightly increased or decreased.

Calculation of Area Proportion of Black Part

Next, calculated is the area ratio of the black part to the entire binarized image based on the reflected electron image. For example, the area ratio may be calculated by arithmetic processing of determining the area of the entire binarized image and the area of the black part, and dividing the area of the black part by the area of the entire binarized image, or may be calculated by arithmetic processing of dividing the number of pixels (number of dots) of the black part by the number of pixels of the entire binarized image.

In the reflected electron image, the region with the wax present looks black, whereas the region without the wax present appears white, and the area proportion of the black part to the entire binarized image can be considered as the coverage of the wax.

In the oil-less fixed image, it is preferable to define the coverage of the wax at the site with the largest amount of toner adhesion. In the case of employing the oil-less fixing method, the wax that decreases the adhesion between the energy ray-curable pressure-sensitive composition and the oil-less fixed image is supplied only from the toner. Accordingly, in the oil-less fixed image, the site with the largest amount of wax is a site with a large amount of toner adhesion, that is, a solid part of the image.

In electrophotographic image formation, various colors are reproduced with the use of toners of four colors of: black; magenta; cyan; and yellow. Thus, among the solid images of the oil-less fixed image, the red, blue, and green sites are sites that have larger amounts of toner adhesion than black, and also have higher wax contents.

To explain again, a fixed solid image of at least any one of red, green, and blue is exposed to saturated vapor of an aqueous ruthenium tetroxide solution with the use of the test chart No. 7 2008 of the Imaging Society of Japan. Thereafter, the image is irradiated with electron beams at an acceleration voltage of 0.8 kV with the use of an electron microscope, and the reflected electron image obtained is converted into a binarized image including a black part and a white part. The proportion of the area of the black part to the area of the entire binarized image is referred to as a wax coverage. The coverage of the wax from 40% to 70% results in favorable adhesion to the energy ray-curable pressure-sensitive composition, thereby providing a removable information sheet with high durability, which produces a beautiful image with a luxurious feeling when the sheet is peeled off.

The coverage of the wax varies depending on the content and distribution state of the wax in the toner, and the type of the wax. As the content of the wax in the toner is decreased, the coverage of the wax is decreased, and as the wax in the toner is increased near the toner surface, the coverage of the wax is increased. In addition, the use of a wax that is lower in melting point and higher in fluidity increases the coverage of the wax of the oil-less fixed image.

In addition, the coverage of the wax of the oil-less fixed image also changes depending on the amount of toner adhesion, and the coverage of the wax is decreased as the amount of toner adhesion is smaller. The image provided with the energy ray-curable pressure-sensitive adhesive has a flat image surface, and the image thus looks darker than usual, thereby allowing for the reduced amount of toner adhesion and the reduced coverage of the wax.

In addition, the coverage of the wax of the oil-less fixed image also changes depending on the fixing conditions. Naturally, the coverage of the wax of the oil-less fixed image is increased with the increased fixing temperature, the increased time of heating by the fixing roller, and the increased pressure of the fixing roller.

As described above, there are various factors that change the coverage of the wax of the oil-less fixed image. If each condition is determined, however, the coverage of the wax of the oil-less fixed image is easily set to be a substantially constant value. The removal information sheet provided with the energy ray-curable pressure-sensitive composition and subjected to pressure bonding is high in durability, and capable of providing a beautiful image with a luxurious feeling when the sheet is peeled off.

EXAMPLES

Hereinafter, the present invention will be described more specifically with reference to examples and comparative examples, but the present invention is not to be considered limited by these examples.

In the following examples and comparative examples, the weight average molecular weight of the resin, the glass transition temperature of the resin, the isoparaffin content of the wax, and the weight average molecular weight of the wax were analyzed with the use of the methods described below.

Weight Average Molecular Weight

The weight average molecular weight of the resin was measured by gel permeation chromatography (GPC). The column was stabilized in a heat chamber at 40° C. Into the column stabilized at this temperature, tetrahydrofuran (THF) as a solvent was allowed to flow at a flow rate of 1 mL per minute, and 50 μL to 200 μL of a THF sample solution of resin adjusted to 0.05% by mass to 0.6% by mass as a sample concentration was injected to perform the measurement.

For measuring the molecular weight of the sample, the molecular weight distribution of the sample was calculated from the relationship between the logarithmic value of a calibration curve prepared from several types of monodisperse polystyrene standard samples and the number of counts. As the standard polystyrene samples for preparing the calibration curve, with the use of samples of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ in molecular weight from Pressure Chemical Co., Ltd. or Tosoh Corporation, it is appropriate to use the standard polystyrene samples at approximately at least 10 points. In addition, an RI (refractive index) detector was used for the detector.

Glass Transition Temperature

The glass transition temperature of the resin was measured with a DSC curve obtained by differential scanning calorimetry (DSC). The DSC curve was measured under the following measurement conditions with the use of TA-60WS and DSC-60 (from SHIMADZU CORPORATION).

Measurement Conditions

- Sample container: sample pan made of aluminum (with lid)
- Sample amount: 5 mg
- Reference: sample pan made of aluminum (alumina: 10 mg)
- Atmosphere: nitrogen (flow rate: 50 mL/min)
- Temperature conditions
  - Start temperature: 20° C.
  - Rate of temperature increase: 10° C./min
  - End temperature: 150° C.
  - Holding time: none
  - Rate of temperature decrease: 10° C./min
  - End temperature: 20° C.
  - Holding time: none
  - Rate of temperature increase: 10° C./min
  - End temperature: 150° C.

The measurement results were analyzed with the use of data analysis software TA-60, version 1.52 (from SHIMADZU CORPORATION). In analyzing the measurement results, the range of ±5° C. was specified around the maximum peak of the DrDSC curve, which is the DSC differential curve for the second temperature increase, and the peak temperature was determined with the use of the peak analysis function of the data analysis software. Next, the maximum endothermic temperature of the DSC curve was determined with the use of the peak analysis function of the data analysis software in the range between the peak temperatures +5° C. and −5° C. of the DSC curve. This temperature corresponds to the melting point. For the endothermic peak as a main peak at a temperature in the range from 40° C. to 100° C., obtained in the process of temperature increase, the intersection point between the line at the midpoint of the baseline before and after the endothermic peak and the differential thermal curve in this case was defined as a glass transition temperature (Tg).

Isoparaffin Content in Wax and Weight Average Molecular Weight of Wax

The isoparaffin content (% by mass) in the wax and the weight average molecular weight of the wax were measured by a field desorption (FD) method with the use of JMS-T100GC "AccuTOF GC" (from by JEOL Ltd.) as a gas chromatograph TOF-type mass spectrometer.

Resin Solution A

To a 500 ml reaction container equipped with a stirrer, a nitrogen gas inlet, a thermometer, and a reflux condenser, 100 parts in total of a monomer including (10 parts of 2-ethylhexyl acrylate, 30 parts of 2-hydroxyl acrylate, 50 parts of butyl methacrylate, and 10 parts of acrylic acid), 100 parts of isopropyl alcohol as a polymerization solvent, and 1 part of azobisisobutylnitrile as a polymerization initiator were added, and subjected to polymerization at 82° C. for 6 hours under isopropyl alcohol reflux in a nitrogen gas stream to obtain a [Resin Solution A] containing 50% by weight of a transparent and viscous resin component ((meth)acrylic copolymer for use in the present invention). The resin obtained was 50,000 in weight average molecular weight. In addition, the glass transition temperature was −0.1° C.

Intermediate Precursor A

An [Intermediate Precursor A] was obtained by stirring and mixing 40 parts of Lipoxy SP-1509 (epoxy acrylate oligomer from Showa Polymer Co., Ltd.), 40 parts of tetraethylene glycol diacrylate, 20 parts of ARONIX M-400 (dipentaerythritol hexaacrylate from Toagosei Co., Ltd.), 5 parts of 2-hydroxy-2-methyl-1-phenyl-propane-1-one (from BASF), and 0.1 parts of methoquinone.

Energy Ray-Curable Pressure-Sensitive Composition Precursor 1

A transparent [Energy Ray-curable Pressure-sensitive Composition Precursor 1] in solution was obtained by blending 60 parts of the [Resin Solution A] with respect to 105.1 parts of the [Intermediate Precursor A].

Example 1

Preparation of Toner 1

Formulation

Polyester resin (weight average molecular weight Mw: 68,500, glass transition temperature Tg: 65.9° C.) . . . 89.5 parts by mass Microcrystalline wax (isoparaffin content: 15% by mass, weight average molecular weight Mw: 645) . . . 5 parts by mass Carbon black (#44 from Mitsubishi Chemical Corporation) . . . 5 parts by mass Charging control agent (Spilon Black TR-H from Hodogaya Chemical Co., Ltd.) . . . 1 part by mass The foregoing formulation was mixed, subjected to kneading at 120° C. with the use of a twin-screw extruder (BCTA type, from Baler), then subjected to grinding and classification by a pneumatic grinder (Jet Mill from NISSHIN ENGINEERING INC.) to a weight average particle diameter of 11.0 μm, and mixed with 2.2% by mass of silica (R-972 from NIPPON AEROSIL CO., LTD.) with the use of a Henschel mixer (FM type, from Mitsui Miike Kakoki Co., Ltd.) to prepare a [Black Toner 1].

In the same manner as in the production of the [Black Toner 1] except for the use of C.I. Pigment Yellow 17 instead of the carbon black in the production of [Black Toner 1], a [Yellow Toner 1] was prepared.

In the same manner as in the production of the [Black Toner 1] except for the use of C.I. Pigment Red 57 instead of the carbon black in the production of [Black Toner 1], a [Magenta Toner 1] was prepared.

In the same manner as in the production of the [Black Toner 1] except for the use of C.I. Pigment Blue 15 instead of the carbon black in the production of [Black Toner 1], a [Cyan Toner 1] was prepared.

The obtained [Toner 1] for each color of black, yellow, magenta, and cyan was 0.90 in average circularity, and 6.8 μm in volume average particle diameter Dv.

Preparation of Developer 1

With the use of a carrier obtained by coating magnetite particles of 50 μm in volume average particle diameter with a silicon resin so as to have an average thickness of 0.5 μm, the [Toner 1] for each color was mixed such that the toner concentration was 5.0 mass %, thereby preparing a [Developer 1] for each color of black, yellow, magenta, and cyan.

Preparation of Printed Matter

The test chart No. 7 2008 of the Imaging Society of Japan was output onto an A4 size of OK top coat 110 kg paper as a recording medium with imagio MP C7500 from Ricoh Co., Ltd. with the use of the [Developer 1] to obtain a printed matter. In this regard, a toner image was obtained by oil-less fixing.

Measurement of Size of Region of Toner Image Flat Part

Blue, Green, and Red solid parts (the three solid parts surrounded by the dashed line in FIG. 4) of the printed matter were cut out, and an SEM image thereof was obtained at acceleration voltage: 3 kV and magnification: 100 times with the use of a field emission scanning microscope JMS-7400F from JEOL Ltd. The size of the region of the toner image flat part was measured from the acquired SEM image. The result is shown in Table 2. It is to be noted that the region of the toner image flat part represents the maximum value obtained from the blue, green, and red solid parts of the printed matter.

Measurement of Coverage of Wax

The blue, green, and red solid parts of the printed matter were cut out, and exposed to saturated vapor of a 5% by mass aqueous solution of ruthenium tetroxide (from TABB) for 5 minutes to be chemically modified with the ruthenium tetroxide. Next, a reflected electron SEM image of the image surface of the printed matter chemically modified was obtained at an acceleration voltage of 0.8 kV and a magnification of 1,000 times with the use of a transmission electron microscope/scanning electron microscope (ULTRA 55 from Garl Zeiss). Image processing of dividing (binarizing) the constituent pixels of the reflected electron SEM image obtained into a black part and a white part by Photoshop (from Adobe) was performed to obtain a binarized image. Measured was the proportion of the area of the black part to the area of the entire binarized image (wax coverage). The result is shown in Table 2. It is to be noted that Table 2 shows the maximum value among the wax coverages obtained from the fixed solid images for each color of red, green, and blue.

Preparation of Removal Information Sheet

Printed matters were obtained under the same conditions as in the step of preparing the printed matter. Two images of the left side of the test chart No. 7 2008 of the Imaging Society of Japan were, however, output in the vertical direction of A4 as the printed matter herein. The printed matters were coated with the [Energy Ray-curable Pressure-sensitive composition precursor 1] to reach a film thickness of 5 to 6 g/cm$^2$ on one side with the use of a UV varnish coater (SAC-18E) from Hirose Iron Works Co., Ltd., and then subjected to UV curing to form an energy ray-curable pressure-sensitive composition. Next, the image was cut into a width of 150 mm and a length of 150 mm. The faces of the two images, subjected to the surface treatment with the [Energy Ray-curable Pressure-sensitive Composition Precursor 1] were joined to each other, and subjected to pressure bonding by applying a load at a gauge pressure of 100 N/cm$^2$ with a tabletop super calender from YURI ROLL CO., LTD. Next, the faces were subjected to pressure bonding by applying a load at a gauge pressure of 50 N/cm$^2$ with a tabletop super calender from YURI ROLL CO., LTD., processed so as to control the temperature of a roller to 130° C. In this manner, a removable information sheet was prepared. Two samples were prepared as mentioned above, one of the samples was stored in an indoor environment and then peeled off, whereas the other thereof was stored in an environment at 35° C. and 75% for 5 days and then peeled off, and the conditions of the image surfaces were observed. Table 2 has therein criteria for the evaluation after the re-peeling are as follows. The following "very good" or "good" is regarded as passable.

Evaluation Criteria

Very good: Extremely beautiful

Good: Practical level, with ultraviolet-curable pressure-sensitive composition found to be partially peeled with gaze Fair: Ultraviolet-curable composition obviously peeled Poor: Image peeled by re-peeling Comparative Example 1

In the same manner as in Example 1 except that the classification conditions in Example 1 were changed to a

[Toner 2] and a [Developer 2], where the toner was 0.91 in average circularity and 5.6 μm in volume average particle diameter Dv, a sample was prepared.

Comparative Example 2

In the same manner as in Comparative Example 1 except that the pressure bonding on heating was not again performed in Comparative Example 1, a sample was prepared.

Example 2

In the same manner as in Comparative Example 1 except that the imagio MP C 7500 from Ricoh Co., Ltd. was modified for AC transfer from the step of transfer from the intermediate transfer belt to the coated paper in Comparative Example 1, a sample was prepared.

Example 3 in the same manner as in Example 2 except for a [Toner 3] and a [Developer 3] obtained with the use of an ester wax (a mixture of an octadecyl docosanoate, an icosyl docosanoate, a docosyl docosanoate, an octadecyl icosanoate; mass average molecular weight: 620, endothermic peak: 70.8° C., and half value width: 5.3° C.) for the wax in Example 2, a sample was prepared.

Example 4

Preparation of Intermediate Precursor B

An [Intermediate Precursor B] was prepared by mixing 10 parts by mass of a urethane acrylate oligomer (EBECRYL 5129, from Daicel-Cytec Co., Ltd., weight average molecular weight Mw: 800), 41 parts by mass of 1,6-hexanediol diacrylate as a polymerizable unsaturated compound, 10 parts by mass of cyclohexyl acrylate as a polymerizable unsaturated compound, 80 parts by mass of ethyl carbitol acrylate as a polymerizable unsaturated compound, 2.5 parts by mass of ethoxydiethylene glycol acrylate as a polymerizable unsaturated compound, 0.3 parts by mass of hydroquinone monomethyl ether as a polymerization inhibitor, and 6 parts by mass of benzyl(1,2-diphenylethanedione) as a photopolymerization initiator, and stirring the mixture at 60° C. for 20 minute.

Preparation of Removable Information Sheet

In the same manner as in Example 3 except for an [Energy Ray-curable Pressure-sensitive Composition Precursor 2] obtained with the use of the [Intermediate Precursor B] instead of the [Intermediate Precursor A], a sample was prepared.

Example 5

Preparation of Intermediate Precursor C

An [Intermediate Precursor C] was obtained by mixing 60 parts by mass of a polyester acrylate oligomer (EBECRYL 1830, from Daicel-Cytec Co., Ltd., weight average molecular weight Mw: 1,500), 30 parts by mass of bisphenol A ethylene oxide adduct diacrylate (V #700 from OSAKA ORGANIC CHEMICAL INDUSTRY LTD.) as a polymerizable unsaturated compound, 5 parts by mass of 2-ethylhexyl acrylate as a polymerizable unsaturated compound, 20 parts by mass of 1,6-hexanediol diacrylate as a polymerizable unsaturated compound, 2.5 parts by mass of ethoxydiethylene glycol acrylate as a polymerizable unsaturated compound, 0.4 parts by mass of 2,6-di tert-butyl-p-cresol (BHT) as a polymerization inhibitor, and 9 parts by mass of IRGACURE 184 (from Ciba Specialty Chemicals Inc.) as a photopolymerization initiator, and stirring the mixture at 60° C. for 20 minute.

Preparation of Removable Information Sheet

In the same manner as in Example 3 except for an [Energy Ray-curable Pressure-sensitive Composition Precursor 3] obtained with the use of the [Intermediate Precursor C] instead of the [Intermediate Precursor A], a sample was prepared.

Example 6

Intermediate Precursor D

In a beaker, 9 parts by mass of pentaerythritol tetraacrylate as a polymerizable unsaturated compound, 2.5 parts by mass of ethoxydiethylene glycol acrylate as a polymerizable unsaturated compound, 30 parts by mass of trimethylolpropane triacrylate as a polymerizable unsaturated compound, and 0.3 parts by mass of hydroquinone as a polymerization inhibitor were put, and heated up to 120° C. while stirring, and 50 parts by mass of a diallyl phthalate prepolymer (Daiso DAP 100 from Daiso Co., Ltd.) was further dissolved therein. Furthermore, 2 parts by mass of aluminum isopropylate dispersed in 2 parts by mass of toluene was gradually added, and the mixture was stirred at 110° C. for 20 minutes. During this time, the toluene added as a solvent was removed to the outside of the system to obtain a [Photocurable Varnish Base Agent]. Next, 70 parts by mass of the [Photocurable Varnish Base Agent], 60 parts by mass of 1,6-hexanediol diacrylate as a polymerizable unsaturated compound, 10 parts by mass of benzophenone as a photopolymerization initiator, 5 parts by mass of p-dimethylaminoacetophenone, 10 parts by mass of phenyl glycol monoacrylate as a viscosity modifier, and 4.5 parts by mass of polyoxyethylene glycol alkyl ether as a surfactant were mixed, and thoroughly subjected to kneading with a triple roll mill to obtain an [Intermediate Precursor D].

Preparation of Removable Information Sheet

In the same manner as in Example 3 except for an [Energy Ray-curable Pressure-sensitive Composition Precursor 4] obtained with the use of the [Intermediate Precursor D] instead of the [Intermediate Precursor A], a sample was prepared.

Example 7

Preparation of Intermediate Precursor E

An [Intermediate Precursor E] was obtained by mixing 60 parts by mass of a polyester acrylate oligomer (EBECRYL 1830, from Daicel-Cytec Co., Ltd., weight average molecular weight Mw: 1,500), 30 parts by mass of bisphenol A ethylene oxide adduct diacrylate (V #700 from OSAKA ORGANIC CHEMICAL INDUSTRY LTD.) as a polymerizable unsaturated compound, 3 parts by mass of 2-ethylhexyl acrylate as a polymerizable unsaturated compound, 20 parts by mass of 1,6-hexanediol diacrylate as a polymerizable unsaturated compound, 2.5 parts by mass of ethoxydiethylene glycol acrylate as a polymerizable unsaturated compound, 0.4 parts by mass of 2,6-di tert-butyl-p-cresol (BHT) as a polymerization inhibitor, 9 parts by mass of IRGACURE 184 (from Ciba Specialty Chemicals Inc.) as a photopolymerization initiator, and 2 parts by mass of sodium dialkylsulfosuccinate as an anionic surfactant, and stirring the mixture at 60° C. for 20 minute.

Preparation of Removable Information Sheet

In the same manner as in Example 3 except for an [Energy Ray-curable Pressure-sensitive Composition Precursor 5] obtained with the use of the [Intermediate Precursor E] instead of the [Intermediate Precursor A], a sample was prepared.

Example 8

Production of Toner 4

Synthesis of Unmodified Polyester (Low Molecular Weight Polyester)

In a reaction tank equipped with a cooling tube, a stirrer, and a nitrogen introduction tube, 67 parts by mass of bisphenol A-2 mol ethylene oxide adduct, 84 parts by mass of bisphenol A-3 mol propylene oxide adduct, 274 parts by mass of terephthalic acid, and 2 parts by mass of dibutyltin oxide were put, and reacted at 230° C. for 8 hours under normal pressure. Next, the reaction liquid obtained was reacted for 6 hours under reduced pressure of 10 mmHg to 15 mmHg to synthesize an [Unmodified Polyester]. The [Unmodified Polyester] obtained was 2,200 in number average molecular weight (Mn), 5,700 in weight average molecular weight Mw, and 56° C. in glass transition temperature Tg.

Preparation of Masterbatch (MB)

A Henschel mixer (from Mitsui Mining Co., Ltd.) was used to mix 1,000 parts by mass of water, 540 parts by mass of carbon black (Printex 35, from Degussa AG, DBP oil absorption=42 mL/100 g, pH=9.5), and 1,200 parts by mass of the unmodified polyester. The obtained mixture was subjected to kneading with two rolls at 150° C. for 30 minutes, then rolled and cooled, and subjected to grinding with a pulverizer (from Hosokawa Micron Corporation) to prepare a [Masterbatch].

Synthesis of Prepolymer

In a reaction container equipped with a cooling tube, a stirrer, and a nitrogen introduction tube, 682 parts by mass of bisphenol A-2 mol ethylene oxide adduct, 81 parts by mass of bisphenol A-2 mol propylene oxide adduct, 283 parts by mass of terephthalic acid, 22 parts by mass of trimellitic anhydride, and 2 parts by mass of dibutyltin oxide were prepared, and reacted at 230° C. for 8 hours under normal pressure. Then, the liquid was reacted for 5 hours under reduced pressure of 10 mmHg to 15 mmHg to synthesize an [Intermediate Polyester]. The obtained [Intermediate Polyester] was 2,100 in number average molecular weight Mn, 9,600 in weight average molecular weight Mw, 55° C. in glass transition temperature Tg, 0.5 mgKOH/g in acid value, and 49 mgKOH/g in hydroxyl value. Next, in a reaction container equipped with a cooling tube, a stirrer, and a nitrogen introduction tube, 411 parts by mass of the [Intermediate Polyester], 89 parts by mass of isophorone diisocyanate, and 500 parts by mass of ethyl acetate were prepared, and reacted at 100° C. for 5 hours to synthesize a [Prepolymer] (modified polyester capable of reacting with an active hydrogen group-containing compound). The free isocyanate content of the obtained [Prepolymer] was 1.60% by mass, and the solid content concentration (after standing at 150° C. for 45 minutes) of the [Prepolymer] was 50% by mass.

Synthesis of Ketimine (Active Hydrogen Group-Containing Compound)

In a reaction container equipped with a stirring rod and a thermometer, 30 parts by mass of isophoronediamine and 70 parts by mass of methyl ethyl ketone were prepared, and reacted at 50° C. for 5 hours to synthesize a [Ketimine Compound] (active hydrogen group-containing compound). The obtained [Ketimine Compound] (active hydrogen group-containing compound) was 423 in amine value.

Synthesis of Styrene-Acrylic Copolymer Resin

In a reaction tank equipped with a cooling tube, a stirrer, and a nitrogen introduction tube, 300 parts by mass of ethyl acetate was prepared, and with 300 parts by mass of a styrene-acrylic monomer mixture (styrene/2-ethylhexyl acrylate/acrylic acid/2-hydroxylethyl acrylate=75/15/5/5) and 10 parts by mass of azobisisobutylnitrile put therein, reacted at 60° C. for 15 hours in a nitrogen atmosphere under normal pressure. Next, a [Styrene-Acrylic Copolymer Resin] was synthesized by adding 200 parts by mass of methanol to the reaction liquid, stirring for 1 hour, then removing the supernatant, and drying under reduced pressure.

Preparation of Solution or Dispersion Liquid of Toner Material

In a beaker, 10 parts by mass of the [Prepolymer], 60 parts by mass of the [Unmodified Polyester], 130 parts by mass of ethyl acetate, and 30 parts by mass of the [Styrene-Acrylic Copolymer Resin] were put, and stirred and dissolved. Next, 2 parts by mass of a microcrystalline wax (isoparaffin content: 14.5% by mass, weight average molecular weight Mw: 650), 8 parts by mass of an ester wax, and 10 parts by mass of the [Masterbatch] were prepared, and subjected to 3 passes under the conditions of liquid feeding speed: 1 kg/hour, disk peripheral speed: 6 m/sec, and filling with 80% by volume of zirconia beads of 0.5 mm in diameter with the use of a bead mill (Ultra Viscomill from AIMEX CO., Ltd.) to prepare a raw material solution, and 2.7 parts by mass of the [Ketimine] was added and dissolved thereto, thereby preparing a solution or dispersion liquid of the toner material.

Preparation of Aqueous Medium Phase

An aqueous medium phase was prepared by mixing and stirring, and uniformly dissolving 306 parts by mass of ion-exchanged water, 265 parts by mass of a 10% by mass tricalcium phosphate suspension, and 0.2 parts by mass of sodium dodecylbenzenesulfonate.

Preparation of Emulsification or Dispersion Liquid

Into a container, 150 parts by mass of the aqueous medium phase was put, stirred at a revolution speed of 12,000 rpm with the use of a TK-type homomixer (from Tokushu Kika Kogyo Co., Ltd.), and 100 parts by mass of the toner material solution or dispersion liquid was added to the phase, and mixed for 10 minutes to prepare an emulsion or dispersion liquid (emulsified slurry).

Removal of Organic Solvent

In a flask equipped with a stirrer and a thermometer, 100 parts by mass of the emulsified slurry was prepared, and the solvent was removed at 30° C. for 12 hours while stirring at a stirring peripheral speed of 20 m/min to obtain a dispersion slurry.

Washing and Drying

After filtering 100 parts by mass of the dispersion slurry under reduced pressure, the filter cake was, with 100 parts by mass of ion-exchanged water added thereto, mixed (at a revolution speed of 12,000 rpm for 10 minutes) with a TK-type homomixer, and then filtered. Performed two times was the operation of mixing the obtained filter cake with 300 parts by mass of ion-exchanged water thereto (at a revolution speed of 12,000 rpm for 10 minutes) with a TK-type homomixer and filtering the mixture. The obtained filter cake was, with 20 parts by mass of a 10% by mass aqueous sodium hydroxide solution thereto, mixed (at a revolution speed of 12,000 rpm for 30 minutes) with a TK-type homomixer, and then filtered under reduced pressure. The obtained filter cake was, with 300 parts by mass of ion-exchanged water added thereto, mixed (at a revolution speed of 12,000 rpm for 10 minutes) with a TK-type homomixer, and then filtered. Performed two times was the operation of mixing the obtained filter cake with 300 parts by mass of ion-exchanged water thereto (at a revolution speed of 12,000 rpm for 10 minutes) with a TK-type homomixer and filtering the mixture. The obtained filter cake was, with 20 parts by mass of 10% by mass hydrochloric acid added thereto, mixed (at a revolution speed of 12,000 rpm for 10 minutes) with a TK-type homomixer, and then filtered. The operation of mixing the obtained filter cake with 300 parts by mass of ion-exchanged water thereto (at a revolution speed of 12,000 rpm for 10 minutes) with a TK-type homomixer and filtering the mixture was performed two times to obtain a final filter cake. The obtained final filter cake was dried at 45° C. for 48 hours in an air-circulation dryer, and sieved through a mesh with an opening of 75 μm to obtain a [Toner Matrix Particles].

External Addition Treatment

With respect to 100 parts by mass of the obtained [Toner Matrix Particles], 0.6 parts by mass of hydrophobic silica of 100 nm in average particle diameter, 1.0 parts by mass of titanium oxide of 20 nm in average particle diameter, and 0.8 parts by mass of a hydrophobic silica fine powder of 15 nm in average particle diameter were mixed with a Henschel mixer to obtain a [Black Toner 4].

In the same manner as in the production of [Black Toner 4] except for the use of C.I. Pigment Yellow 17 instead of the carbon black in the preparation of [Black Toner 4], a [Yellow Toner 4] was prepared.

In the same manner as in the production of the [Black Toner 4] except for the use of C.I. Pigment Red 57 instead of the carbon black in the production of [Black Toner 4], a [Magenta Toner 4] was prepared.

In the same manner as in the production of the [Black Toner 4] except for the use of C.I. Pigment Blue 15 instead of the carbon black in the production of [Black Toner 4], a [Cyan Toner 4] was prepared.

For the obtained [Toners 4] for each color of black, yellow, magenta, and cyan, the average circularity measured as follows was 0.94, and the volume average particle diameter Dv was 5.7 μm.

Production of Developer 4

Production of Carrier

A coating film forming solution of an acrylic resin and a silicon resin including alumina particles was obtained by dispersing 21.0 parts by mass of an acrylic resin solution (toluene solution of cyclohexyl methacrylate/methyl methacrylate=80/20 (ratio by mass) copolymer, synthesis from monomers from Mitsubishi Rayon Co., Ltd., solid content: 50% by mass), 6.4 parts by mass of a guanamine solution (SUPER BECKAMINE TD-126, from DIC Corporation, solid content: 70% by mass), 7.6 parts by mass of alumina particles (SUMICORANDOM AA-03, from Sumitomo Chemical Company, Limited, average particle diameter: 0.3 μm, specific resistance value: $10^{14}$ (Ω·cm)), 65.0 parts by mass of a silicon resin solution (SR2410 from Dow Corning Toray Silicone Co., Ltd., solid content: 23% by mass), 1.0 parts by mass of aminosilane (SH6020 from Dow Corning Toray Silicone Co., Ltd., solid content: 100% by mass), 60 parts by mass of toluene, and 60 parts by mass of butyl cellosolve with a homomixer for 10 minutes.

With the use of a fired ferrite powder [$(MgO)_{1.8}(MnO)_{49.5}(Fe_2O_3)_{48.0}$: average particle diameter 35 μm] as a core material, the coating film forming solution was applied to the surface of the core material with a Spira coater (from Okada Seiko Co., Ltd.) so as to have a thickness of 0.15 μm, and dried, and the product was then left to stand at 150° C. for 1 hour in an electric furnace, and subjected to firing. After cooling, the fired product was crushed with the use of a sieve of 106 μm in mesh size to obtain a carrier with a weight average particle diameter of 35 μm.

A [Developer 4] for each color was obtained by uniformly mixing and charging 7 parts by mass of the [Toner 4] for each color with respect to 100 parts by mass of the carrier with the use of a tumbler mixer of a type for stirring by tumbling a container.

Preparation of Removable Information Sheet

In the same manner as in Example 3 except that the developer in Example 3 was replaced with the [Developer 4], a removable information sheet was prepared.

Example 9

With the use of, as the wax, 10 parts by mass of an ester wax instead of 2 parts by mass of the microcrystalline wax (isoparaffin content: 14.5% by mass, weight average molecular weight Mw: 650) and 8 parts by mass of the ester wax in Example 8, a [Toner 5] and a [Developer 5] were synthesized. The obtained toner was 0.94 in average circularity and 5.7 μm in volume average particle diameter Dv. In the same manner as in Example 8 except for using this toner, a sample was prepared.

Example 10

In the same manner as in Example 9 except for a [Toner 6] and a [Developer 6] of 0.95 in average circularity and of 4.8 μm in volume average particle diameter Dv, obtained by classification of the synthesized toner in Example 9, a sample was prepared.

Comparative Example 3

In the same manner as in Example 10 except for a [Toner 7] and a [Developer 7] obtained with the use of, as the wax, 10 parts by mass of a paraffin wax (weight average molecular weight Mw: 500) instead of 10 parts by mass of the ester wax in Example 10, a sample was prepared.

Example 11

In the same manner as in Example 10 except for image formation with the image density reduced by 6% in Example 10, a sample was prepared.

Example 12

The configuration according to Example 9 was employed to prepare a direct mail image for pressure-bonded postcards (Z type) for overseas travel. In the same manner as in Example 9, an energy ray-curable pressure-sensitive composition precursor layer was formed, and the energy ray-curable pressure-sensitive composition precursor layer was cured by UV irradiation to form an energy ray-curable pressure-sensitive composition. Thereafter, through cutting and a folding step, faces with the energy ray-curable pressure-sensitive composition formed were bonded to each other, and allowed to pass through a heating space in which the temperature of the roller was controlled to 130° C. Thereafter, a load at a gauge pressure of 100 N/cm$^2$ was applied with a tabletop super calender from YURI ROLL CO., LTD., processed for control to 130° C., thereby preparing twenty pressure-bonded postcards. The twenty pressure-bonded postcards prepared were dropped into different postboxes in the Osaka City to be mailed to offices in the Kanagawa Prefecture. When the pressure-bonded postcards after arriving at the offices in the Kanagawa prefecture were peeled off again, very beautiful direct mail images could be seen from all of the pressure-bonded postcards.

Table 1 shows the formulations of the energy ray-curable pressure-sensitive composition precursors used in the foregoing examples and the comparative examples. The numerical values in the table represent parts by mass. In addition, Table 2 shows the sample preparation conditions, measurement results, and evaluation results in the foregoing examples and comparative examples. In Table 2, the "toner particle diameter" means the volume average particle diameter of the toner, and the "Mic" means the microcrystalline wax.

TABLE 1

| | Energy Ray Curable Pressure Sensitive Composition Precursor | | | | |
|---|---|---|---|---|---|
| | 1 | 2 | 3 | 4 | 5 |
| Resin Solution A | 60 | 60 | 60 | 60 | 60 |
| Intermediate Precursor A | 105.1 | | | | |
| Intermediate Precursor B | | 105.1 | | | |
| Intermediate Precursor C | | | 105.1 | | |
| Intermediate Precursor D | | | | 105.1 | |
| Intermediate Precursor E | | | | | 105.1 |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A method for manufacturing a removable information sheet, the method comprising:

forming a toner image on a recording medium with use of a toner;

applying an energy ray-curable pressure-sensitive composition precursor onto the recording medium with the toner image formed to form an energy ray-curable pressure-sensitive composition precursor layer;

irradiating, with an energy ray, the recording medium with the energy ray-curable pressure-sensitive composition precursor layer formed to cure the energy ray-curable pressure-sensitive composition precursor layer and form an energy ray-curable pressure-sensitive composition; and attaching faces with the energy ray-curable pressure-sensitive composition formed to each other and pressure-bonding the faces, wherein a size of a region of a toner image flat part, determined by a measurement method, is 200 μm or less in the toner image formed by the forming, and wherein the measurement method includes:

defining, in a solid part of the toner image, a site at a depth of 2 μm or more from a surface of the solid part as a recess;

TABLE 2

| | Toner Average Circularity | Toner Particle Diameter [μm] | Wax | Developer | Secondary Transfer Method | Size of Region of Toner Image Flat Part [μm] | Energy Ray Curable Pressure Sensitive Composition Precursor | Coverage of Wax [%] | Evaluation: Indoor Environment | Evaluation: High-Temperature High-Humidity Environment | Others |
|---|---|---|---|---|---|---|---|---|---|---|---|
| Example 1 | 0.90 | 6.8 | Mic | 1 | DC Transfer | 198 | 1 | 46 | Very good | Good | |
| Comparative Example 1 | 0.91 | 5.6 | Mic | 2 | DC Transfer | 220 | 1 | 56 | Very good | Fair | |
| Comparative Example 2 | 0.91 | 5.6 | Mic | 2 | DC Transfer | 220 | 1 | 56 | Poor | Poor | no pressure bonding on heating again |
| Example 2 | 0.91 | 5.6 | Mic | 2 | AC Transfer | 155 | 1 | 56 | Very good | Good | |
| Example 3 | 0.90 | 5.6 | Ester Wax | 3 | AC Transfer | 157 | 1 | 48 | Very good | Very good | |
| Example 4 | 0.90 | 5.6 | Ester Wax | 3 | AC Transfer | 157 | 2 | 48 | Very good | Very good | |
| Example 5 | 0.90 | 5.6 | Ester Wax | 3 | AC Transfer | 157 | 3 | 48 | Very good | Very good | |
| Example 6 | 0.90 | 5.6 | Ester Wax | 3 | AC Transfer | 157 | 4 | 48 | Very good | Very good | |
| Example 7 | 0.90 | 5.6 | Ester Wax | 3 | AC Transfer | 157 | 5 | 48 | Very good | Very good | |
| Example 8 | 0.94 | 5.7 | Mic + Ester Wax | 4 | AC Transfer | 113 | 1 | 45 | Very good | Very good | |
| Example 9 | 0.94 | 5.7 | Ester Wax | 5 | AC Transfer | 110 | 1 | 42 | Very good | Very good | |
| Example 10 | 0.95 | 4.8 | Ester Wax | 6 | AC Transfer | 191 | 1 | 55 | Very good | Very good | |
| Comparative Example 3 | 0.95 | 4.8 | Paraffin Wax | 7 | AC Transfer | 205 | 1 | 66 | Good | Fair | |
| Example 11 | 0.95 | 4.8 | Ester Wax | 6 | AC Transfer | 137 | 1 | 55 | Very good | Very good | image density reduced by 6% |

defining a site other than the recess as the toner image flat part;

acquiring a micrograph of the solid part of the toner image;

binarizing the micrograph;

drawing circles out of contact with the recess in the toner image flat part; and defining a diameter of a largest circle among the circles drawn as the size of the region of the toner image flat part.

2. The method according to claim 1, wherein the forming includes:

transferring a toner image on a photoconductor or an intermediate transfer body to the recording medium; and fixing the toner image transferred to the recording medium, and wherein the transferring transfers the toner image with a transfer bias in which a direct-current bias is superimposed on an alternate-current bias.

3. The method according to claim 1, wherein the pressure-bonding pressure-bonds the recording medium while heating the recording medium.

4. The method according to claim 1, wherein the toner comprises an ester-based wax.

5. The method according to claim 1, wherein the forming includes transferring a toner image on a photoconductor or an intermediate transfer body to the recording medium, wherein the transferring includes oil-less fixing without using any lubricant, wherein the toner image obtained in the forming has a wax coverage of 40% to 70% determined by a wax coverage measurement method, and wherein the wax coverage measurement method includes:

acquiring a reflected electron image with use of an electron microscope after exposing a solid part of the toner image at a saturated vapor pressure of an aqueous ruthenium tetroxide solution;

binarizing the reflected electron image depending on whether a brightness determined for each pixel is equal to or more than a threshold value; and defining an area proportion of a black part to an entire binarized image as the wax coverage.

6. The method according to claim 1, wherein:

the pressure-bonding is performed by a roller.

7. The method according to claim 6, wherein:

the pressure-bonding is performed by a heated roller.

8. The method according to claim 1, wherein:

the pressure-bonding is performed by a means for pressure bonding.

* * * * *